US011337584B2

(12) United States Patent
Gonzales

(10) Patent No.: US 11,337,584 B2
(45) **Date of Patent: *May 24, 2022**

(54) SHOE BOTTOM CLEANSING APPARATUS

(71) Applicant: Stomp Patent LLC, Denver, CO (US)

(72) Inventor: David Gonzales, Denver, CO (US)

(73) Assignee: Stomp Patent LLC, Cherry Hills Village, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/838,957

(22) Filed: Apr. 2, 2020

(65) Prior Publication Data

US 2020/0229677 A1 Jul. 23, 2020

Related U.S. Application Data

(63) Continuation-in-part of application No. PCT/US2019/050235, filed on Sep. 9, 2019.

(60) Provisional application No. 62/740,451, filed on Oct. 3, 2018.

(51) Int. Cl.

| | |
|---|---|
| ***A43B 23/02*** | (2006.01) |
| ***A43C 11/00*** | (2006.01) |
| ***A47L 23/04*** | (2006.01) |
| ***A43B 5/18*** | (2006.01) |
| ***A43B 5/00*** | (2022.01) |
| ***A43B 23/26*** | (2006.01) |
| *A43B 3/24* | (2006.01) |

(52) U.S. Cl.

CPC ..... *A47L 23/04* (2013.01); *A43B 5/00* (2013.01); *A43B 5/18* (2013.01); *A43B 23/0245* (2013.01); *A43B 23/26* (2013.01); *A43C 11/004* (2013.01); *A43B 3/24* (2013.01)

(58) Field of Classification Search

CPC ..... A43B 5/18; A43B 5/16; A43B 5/1616

See application file for complete search history.

(56) References Cited

U.S. PATENT DOCUMENTS

| | | | | | |
|---|---|---|---|---|---|
| 3,027,660 | A * | 4/1962 | Werner | A43B 5/18 | 36/7.1 R |
| 3,176,416 | A * | 4/1965 | Seegert | A43B 5/18 | 36/7.1 R |
| 4,823,426 | A * | 4/1989 | Bragga | A47L 23/00 | 15/210.1 |
| 4,837,960 | A * | 6/1989 | Skaja | A43B 23/00 | 36/136 |

(Continued)

FOREIGN PATENT DOCUMENTS

| | | |
|---|---|---|
| KR | 10-1368503 | 2/2014 |

OTHER PUBLICATIONS

International Search Report and Written Opinion Issued in PCT/US2019/050235, dated Nov. 12, 2019, 3 pages.

(Continued)

*Primary Examiner* — Jila M Mohandesi

(74) *Attorney, Agent, or Firm* — Faegre Drinker Biddle & Reath LLP

(57) ABSTRACT

The present disclosure is directed to an apparatus, system and method for efficiently and rapidly cleaning the bottom of a shoe. The system includes a base having a plurality of alternating, complementary shaped cleansing portions separated by grooves. The configuration of the cleansing portions provides for a sturdy and efficient device for cleaning the bottom of a shoe.

10 Claims, 29 Drawing Sheets

(56) References Cited

U.S. PATENT DOCUMENTS 5,234,230 A * 8/1993 Crane ..... A63C 3/00 280/811
5,421,106 A 6/1995 Emrick
5,454,172 A * 10/1995 Crigger ..... A43C 13/08 36/71.5
5,471,768 A 12/1995 Pryor
5,555,564 A 9/1996 Welch
5,701,688 A 12/1997 Crowley
5,829,170 A * 11/1998 Lutz, Jr. ..... A43B 5/1683 36/72 R
5,930,920 A 8/1999 Arnold
5,943,792 A * 8/1999 Powell ..... A43C 15/12 36/62
6,128,801 A 10/2000 Adzick
6,460,274 B1 * 10/2002 Mateu ..... A43B 5/0401 36/115
6,779,280 B2 * 8/2004 Wright ..... A43B 1/0081 36/114
7,316,082 B2 1/2008 Hernandez et al.
7,392,603 B1 * 7/2008 Shepherd ..... A43B 23/26 36/114
7,523,567 B1 4/2009 McClelland
8,959,801 B1 * 2/2015 Siragusa, Jr. ..... A63B 71/1225 36/72 R
9,032,583 B2 5/2015 McLaughlin
9,498,105 B2 11/2016 McLaughlin
9,781,968 B2 * 10/2017 Meraw ..... A43B 3/001
9,833,043 B2 * 12/2017 Ganci ..... A43B 3/16
10,576,341 B2 * 3/2020 Engel ..... A46B 15/0055
10,779,706 B1 9/2020 Gonzales
2001/0042324 A1 * 11/2001 Filice ..... A43B 23/26 36/115
2002/0144434 A1 * 10/2002 Farys ..... A43B 23/26 36/54
2004/0134099 A1 * 7/2004 Jones ..... A43C 11/008 36/50.1
2008/0098625 A1 * 5/2008 Salvatore ..... A43B 3/0031 36/132
2008/0163516 A1 * 7/2008 Camarillo ..... A43B 11/00 36/136
2008/0190975 A1 8/2008 Naughton
2010/0325922 A1 * 12/2010 Esposito ..... A43C 13/00 36/72 R
2011/0016617 A1 * 1/2011 Shrewsburg ..... A63B 71/081 2/411
2011/0078926 A1 * 4/2011 Watkins ..... A63B 57/60 36/127
2011/0083341 A1 * 4/2011 Baum ..... A43B 21/42 36/100
2011/0225844 A1 * 9/2011 Hughes ..... A43C 15/02 36/62
2012/0124863 A1 * 5/2012 Aveni ..... A43B 23/028 36/50.1
2012/0167418 A1 * 7/2012 Frappier ..... A43B 7/085 36/115
2012/0317842 A1 * 12/2012 McClelland ..... A43B 5/18 36/115
2014/0047652 A1 2/2014 McLaughlin et al.
2014/0157625 A1 * 6/2014 Smaldone ..... A43B 5/0401 36/54
2015/0305433 A1 10/2015 Meraw et al.
2017/0095032 A1 * 4/2017 Lacroix ..... A43B 5/002

OTHER PUBLICATIONS

U.S. Appl. No. 29/721,858, titled Shoe Bottom Cleansing Apparatus and filed Jan. 23, 2020.

* cited by examiner

SHOE BOTTOM CLEANSING APPARATUS

CROSS REFERENCE TO RELATED APPLICATIONS

The present patent application is a continuation-in-part of International Application No. PCT/US2019/050235, filed Sep. 9, 2019, which claims priority and benefit under 35 U.S.C. 119(e) to U.S. Ser. No. 62/740,451, filed on Oct. 3, 2018. The entire contents of those documents are hereby expressly incorporated herein by reference.

FIELD OF THE DISCLOSURE

The apparatus, system and method described herein generally relate to efficiently and rapidly cleaning the bottom of a shoe, such as a cleansing portion and attachment member for affixing the cleansing portion to the shoe.

BACKGROUND

The bottom of basketball shoes often become soiled during gameplay. Shoes lose their grip to the court's surface over time due to the accumulation of dust, dirt and other contaminants collected from the court onto the bottom surface of a shoe. Resultantly, shoes and subsequently slide on the court's surface, potentially causing decreased performance and increased risk of injury.

Players often wipe their hands on the bottom of a basketball shoe to cleanse it, which leaves their hands dirty and slick when handling the ball. Often a player's hands will become sweaty from playing basketball. Resultantly, a player will often spit on his or her hand prior to wiping the bottom of the shoes. The associated saliva often contaminates the playing surface that the bottom of the shoe comes into contact with, resulting in an unsanitary playing environment.

Cleaning products are not readily available on the court to clean shoes. Current materials on shoes are not designed for cleaning or wiping away debris. The cleaning material on the shoe will eventually become dirty from wiping bottoms of shoes. A commonly known prior art cleaning solution involves a traction mat placed on the side of the court configured to allow a player to step onto a mat having a sticky surface to remove debris from the bottom of an athletic shoes, however this and similar prior art solutions have the disadvantage of not being accessible on the court of play. Therefore, a player does not have such a solution available to clean the bottom of his or her shoe during the actual gameplay.

Other solutions involve applying a foreign substance to the bottom of a shoe. Such solutions, however, are also generally inaccessible on the field of play during gameplay. In some circumstances, such substances do not make your shoe cleaner, but rather add more foreign substances to the bottom of a shoe. Such substances are prone to wearing away during gameplay. In some situations, substances are damaging to the shoe, limiting the shoe's lifespan.

Prior art solutions lack a practical method to detach a cleaning device. In previously known solutions, cleansing materials intended to remove debris from the bottom of shoes are not strategically positioned. Resultantly, a user cannot easily clean the bottom of his or her shoes while wearing the shoes.

Other solutions involve the use of cloths to remove debris off court. However, cloths are generally not configured to clean the bottom of shoes specifically. The use of a cloth to clean the bottom of the shoe requires a stoppage of activity to facilitate the cleansing. Therefore, an unmet challenge remains to specifically configure a cleaning material to address the dirty underside of athletic shoes.

Some prior art solutions involve a shoe attachment to facilitate cleaning. However, such solutions are not of an optimal size to clean the entirety of the bottom of shoes. An unsolved challenge therefore remains to produce a cleaning surface of a size and configuration to effectively and efficiently cleanse the bottom of the shoe. In some circumstances, prior art shoe cleaning attachments require the player to refill with the gel or cleaning fluids before each game, which is associated with the problems of such gels or cleaning fluids running out or otherwise being inaccessible at the time required for cleansing. Another problem associated with other prior art mechanisms is that they are limited to one size. A need therefore remains to create a cleansing mechanism customizable to fit a variety of shoe sizes.

Prior art mechanisms designed for attaching to shoes sometimes comprise a plastic raised portion affixed to or otherwise integrated within a shoe. However, such a plastic raised portion often presents the problem of player discomfort.

A related problem is that shoelaces associated with athletic shoes regularly become untied. Participants in an athletic activity, therefore, must retie shoes multiple times a game. This re-adjustment of the shoelaces and the shoe during gameplay often results in sub-optimally placed forces deriving from short, quick movements causing the foot to shift in relation to the shoe and its laces. An unsolved challenge, therefore, remains to create a more optimal solution to secure a shoe to one's foot during athletic activity.

Another still-unsolved challenge is that shoes are generally not designed to run through a washing machine. Cleaning attachments, likewise, are generally not configured to run through a washing machine. As a result, shoes often exhibit an unpleasant odor and unsanitary characteristics following gameplay. An unmet challenge, therefore, remains to configure shoes and cleaning mechanisms designed to affix to shoes such that they can run through a washing machine, as well as being hand washable.

A further unsolved challenge is that shoes, particularly athletic shoes, generally have no place to hold money or a key. For athletes specifically, it is often dangerous to hold a sharp object such as a key in one's pocket during gameplay. Contact experienced between players who have such objects in their pocket or otherwise affixed to their bodies in a way that they can come into contact with a player could cause significant injury. Likewise, money can specifically fall out and be lost resulting from the motion associated with athletic gameplay. Alternatively, leaving such objects as keys and money off the court of play during gameplay is associated with a significant risk of theft. Therefore, it remains to be solved how to optimally secure potentially dangerous and/or valuable objects to one's body during gameplay.

Currently, shoes are generally not individually customizable. Current solutions lack multiple options for customizing a shoe with multiple designs and attachments. Athletes, in particular, are noted for developing a sense of individual style. A need therefore remains to create a mechanism to help athletes promote an individual style.

SUMMARY

The present disclosure presents a shoe bottom cleansing apparatus, comprising: a cleansing portion for cleaning a bottom of a shoe; and an attachment member operably connected to the cleansing portion, the attachment member removably attaching the cleansing portion to the shoe.

The shoe bottom cleansing apparatus of the preceding paragraph, wherein the cleansing portioned about a top of the shoe so as to cover at least a portion of laces of the shoe.

The shoe bottom cleansing apparatus of any of the preceding paragraphs, wherein the cleansing portion has a first end and a second end.

The shoe bottom cleansing apparatus of any of the preceding paragraphs, wherein the first and second ends of the cleansing portion are configured to wrap about laces of the shoe.

The shoe bottom cleansing apparatus of any of the preceding paragraphs, wherein the cleansing portion is provided with a plurality of notches for receiving a portion of the attachment member.

The shoe bottom cleansing apparatus of any of the preceding paragraphs, wherein the attachment member is incorporated into the cleansing portion.

The shoe bottom cleansing apparatus of any of the preceding paragraphs, wherein the attachment member is configured as a plurality of attachment members.

The shoe bottom cleansing apparatus of any of the preceding paragraphs, wherein the attachment member is configured to be connects to an underside of the cleansing portion.

The shoe bottom cleansing apparatus of any of the preceding paragraphs, wherein the attachment member has at least one eyelet for receiving laces of a shoe so as to attach the cleansing portion to the shoe.

The shoe bottom cleansing apparatus of any of the preceding paragraphs, further comprising: a platform for placing a brand name or logo.

The present disclosure also presents a shoe bottom cleansing apparatus, comprising: a base having a first end and a second end; a plurality of cleansing portions extending from the base, wherein the cleansing portions comprise: three hexagonal-shaped cleansing portions; two dumbbell-shaped cleansing portions separating each of the three hexagonal-shaped cleansing portions; and a plurality of grooves disposed between the two dumbbell-shaped cleansing portions and the three hexagonal-shaped cleansing portions; and a means for removably attaching the first end and the second end of the base to a top portion of a shoe.

The shoe bottom cleansing apparatus of the previous paragraph, wherein the means for removably attaching the first end and the second end of the base to the top portion of the shoe comprises attaching the base to a portion of laces of the shoe.

The shoe bottom cleansing apparatus of any of the preceding paragraphs, wherein the first and second ends are configured to wrap about laces of the shoe.

The shoe bottom cleansing apparatus of any of the preceding paragraphs, wherein the base comprises a first wing, a second wing and a central section disposed between the first wing and the second wing.

The shoe bottom cleansing apparatus of any of the preceding paragraphs, wherein each of the three hexagonal-shaped cleansing portions comprise a first generally triangularly-shaped area, a second generally triangularly-shaped area and a generally rectangularly-shape area disposed between the first generally triangularly-shaped area and the second generally triangularly-shaped area.

The shoe bottom cleansing apparatus of any of the preceding paragraphs, wherein the first generally triangularly-shaped area is substantially disposed on the first wing, the second generally triangularly-shaped area is substantially disposed on the second wing and the generally rectangularly-shape area is substantially disposed on the central section.

The shoe bottom cleansing apparatus of any of the preceding paragraphs, wherein each of the two dumbbell-shaped cleansing portions comprises a first area, a second area and a bar connecting the first area and the second area.

The shoe bottom cleansing apparatus of any of the preceding paragraphs, wherein the first area comprises a generally triangular shape and the second area comprises a generally triangular shape.

The shoe bottom cleansing apparatus of any of the preceding paragraphs, wherein the first area is substantially disposed on the first wing, the second area is substantially disposed on the second wing and the bar is substantially disposed on the central section.

The shoe bottom cleansing apparatus of any of the preceding paragraphs, wherein each of the two dumbbell-shaped cleansing portions comprises a first area, a second area and a bar connecting the first area and the second area.

The shoe bottom cleansing apparatus of any of the preceding paragraphs, wherein the first area comprises a generally triangular shape and the second area comprises a generally triangular shape.

The shoe bottom cleansing apparatus of any of the preceding paragraphs, wherein the first area is substantially disposed on the first wing, the second area is substantially disposed on the second wing and the bar is substantially disposed on the central section.

BRIEF DESCRIPTION OF THE DRAWING(S)

DETAILED DESCRIPTION

Figure 1:
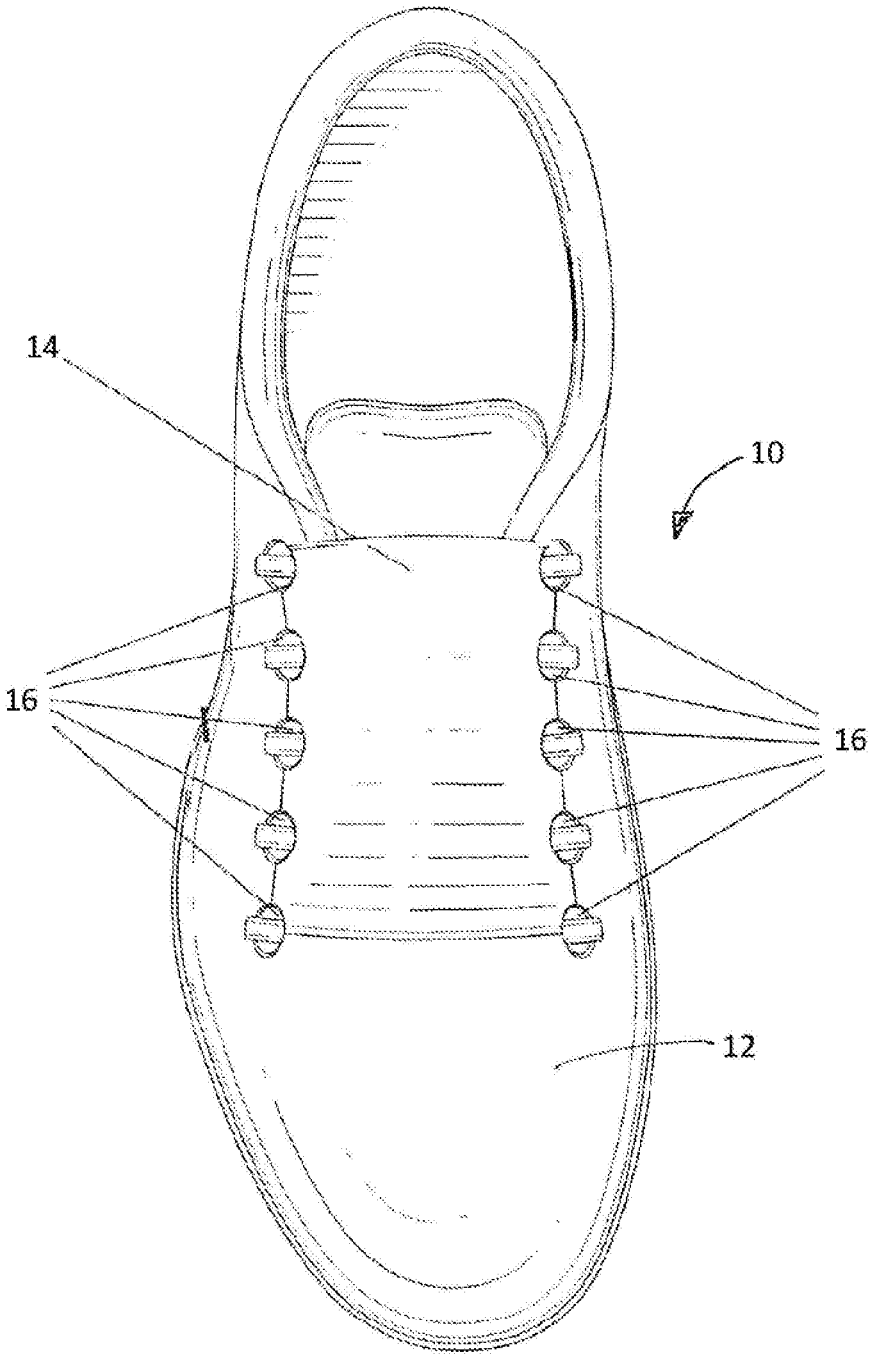
FIG. 1 depicts a top view of one embodiment of a shoe bottom cleansing apparatus attached by standard shoelaces to a shoe.

Before explaining at least one embodiment of the inventive concept disclosed herein in detail, it is to be understood that the inventive concept is not limited in its application to the details of construction, experiments, exemplary data, and/or the arrangement of the components set forth in the following description, or illustrated in the drawings. The presently disclosed and claimed inventive concept is capable of other embodiments or of being practiced or carried out in various ways. Also, it is to be understood that the phraseology and terminology employed herein is for purpose of description only and should not be regarded as limiting in any way.

In the following detailed description of embodiments of the inventive concept, numerous specific details are set forth in order to provide a more thorough understanding of the inventive concept. However, it will be apparent to one of ordinary skill in the art that the inventive concept within the disclosure may be practiced without these specific details. In other instances, well-known features have not been described in detail to avoid unnecessarily complicating the instant disclosure.

Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the inventive concept. This description should be read to include one or at least one and the singular also includes the plural unless it is obvious that it is meant otherwise.

Finally, as used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

Referring now to the drawings, and more particularly to FIG. 1, shown therein is an exemplary embodiment of a shoe bottom cleansing apparatus 10 constructed in accordance with the inventive concepts disclosed herein, the show bottom cleansing apparatus attached to a shoe 12. The teachings and disclosures related to embodiments of the invention relate to a shoe bottom cleansing apparatus intended to remove debris, such as dirt and dust, from the bottom of athletic shoes. In embodiments of the invention, during the intended method of use debris removal utilizing the apparatus allow a user to remove debris from the bottom of athletic shoes he or she is wearing without dirtying his or her hands, and without stoppage of athletic gameplay.

The shoe bottom cleansing apparatus 10 is provided with a cleansing portion 14. The cleansing portion 14 is further configured to affix to a shoe. The cleansing portion 14 provides a surface portion variably sized to correspond with the top portion of a shoe above its tongue. In embodiments of the invention, the cleansing portion's 14 usable surface faces upward, allowing for the user to drag the bottom of the opposite shoe across the cleansing portion 14 to accomplish the desired cleaning of the bottom of the opposite shoe during intended use.

In an embodiment, the design for the cleansing portion 14 includes a cleaning material with elastic edges. The elastic edges allow for stretching of the cleansing portion 14 after the embodiment is affixed to a shoe. In an embodiment, the cleansing portion 14 further comprises an elastic border along a portion of the edge of the cleansing portion. In an embodiment, the elastic border comprises an elastic string. In an embodiment, the elastic border comprises nylon polyester.

Figure 2:
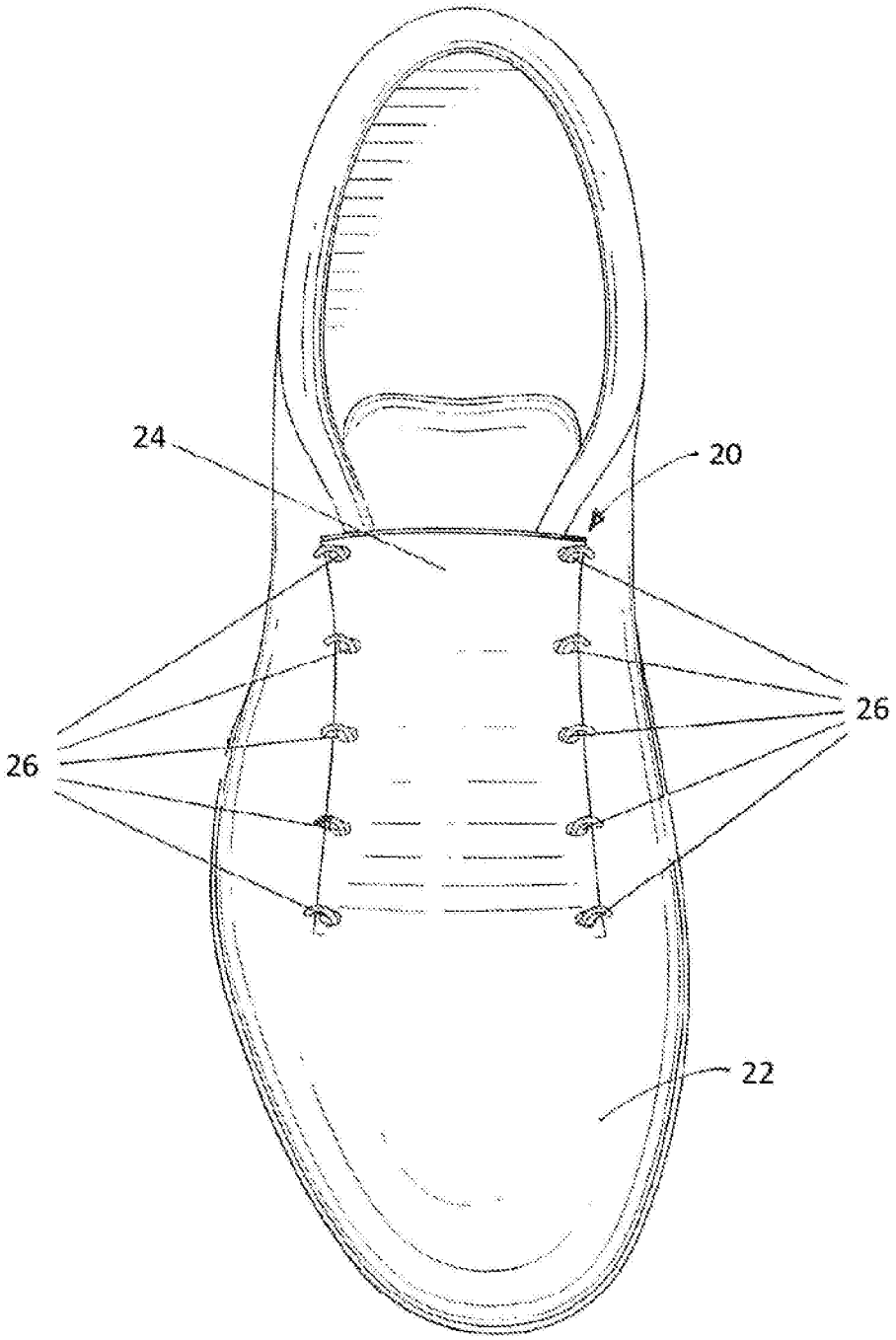
FIG. 2 depicts a top view of another embodiment of show bottom cleansing apparatus connected to a shoe by a plurality of connection apertures.

In the preferred embodiment, the cleansing portion 14 comprises microfiber, cotton, wool, suede, felt, rubber, leather or another similar material as apparent to one skilled in the art. In another embodiment, the cleansing material may be glow in the dark and light reflective materials. During the intended use, a user may spray the cleansing portion 14 with a variety of cleaning fluids as known by one skilled in the art to enhance the cleaning action. In the preferred embodiment of the invention, the cleansing portion's 14 materials allow for durability of the invention to prevent splitting and/or tearing. In the preferred embodiment, the dimensions of the cleansing portion 14 measure 2-4 inches wide by 3-6 inches in height, which the present inventor recognizes is an appropriate size for the shoes associated with intended uses. In embodiments of the invention, the material comprising the cleansing portion extends beyond the entire portion of the laces, as depicted in FIGS. 1 and 2. The resultant large surface space of the cleansing portion 14 provides the user with the ability entire bottom of shoe as the shoe is swiped across the cleansing portion 14. Moreover, in an alternative use, an athlete can wipe their hands across the surface portions as placed to clean sweaty hands off.

The shoe bottom cleansing apparatus 10 easily attaches to a shoe 12 by weaving the laces of a shoe through connection apertures 16 incorporated either directly into the cleansing portion 14 or into a shoe attachment piece (FIGS. 6A and 6B) affixed to the cleansing portion 14. In alternative embodiments, connection apertures 26 are incorporated directly into a cleansing portion 24 of a shoe bottom cleansing apparatus 20 attached to a shoe 22, as depicted in FIG. 2.

Figure 3:
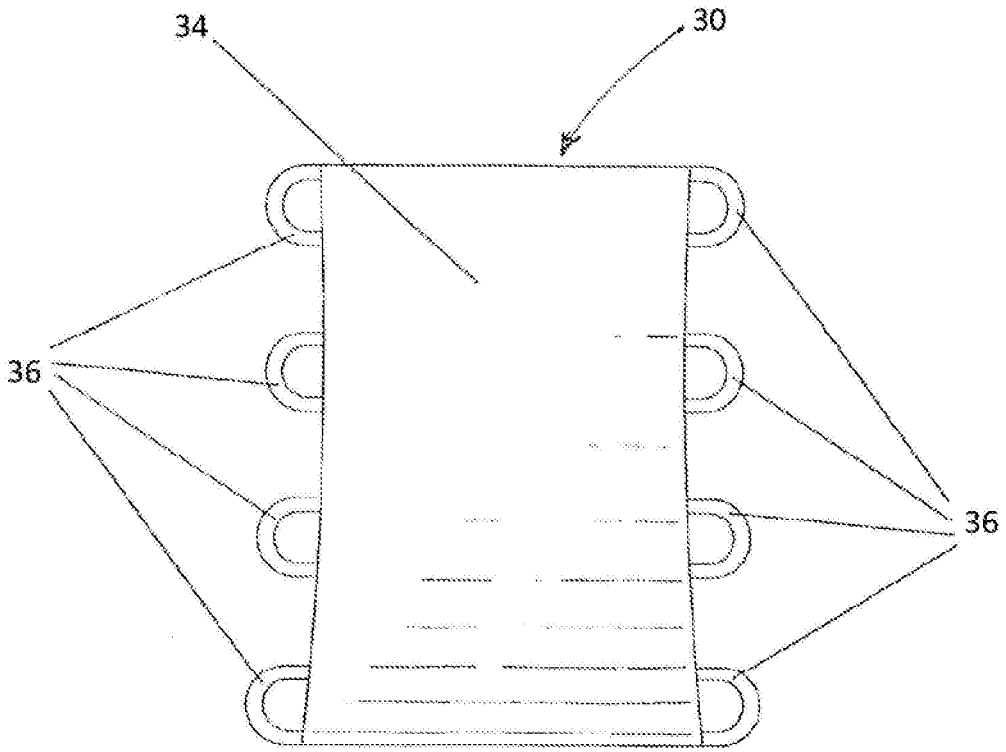
FIG. 3 depicts a top view of another embodiment of a shoe bottom cleansing apparatus featuring lace threading loops.

In one embodiment, as shown in FIG. 3, a shoe bottom cleansing apparatus 30 has a plurality of connection apertures 36 connected to a cleansing portion 34.

Figure 4:
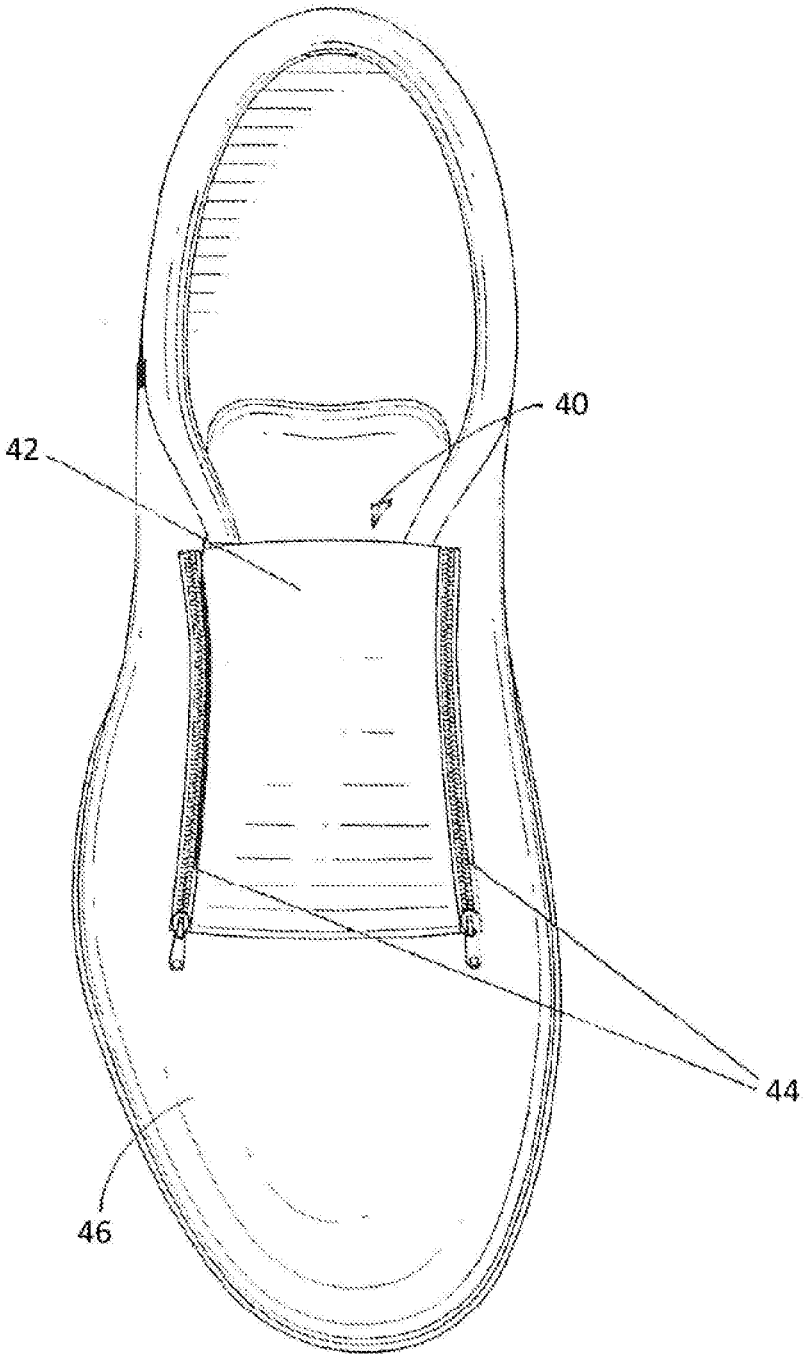
FIG. 4 depicts a top view of another embodiment of a shoe bottom cleansing apparatus connectably linked to a shoe by a plurality of zippers.

In an embodiment, a cleansing portion 42 of a shoe bottom cleansing apparatus 40 is affixed to a shoe attachment piece 44 which is attached to a shoe 46. In an embodiment, such attachment 44 is accomplished by a zipper, as depicted in FIG. 4.

Figure 5:
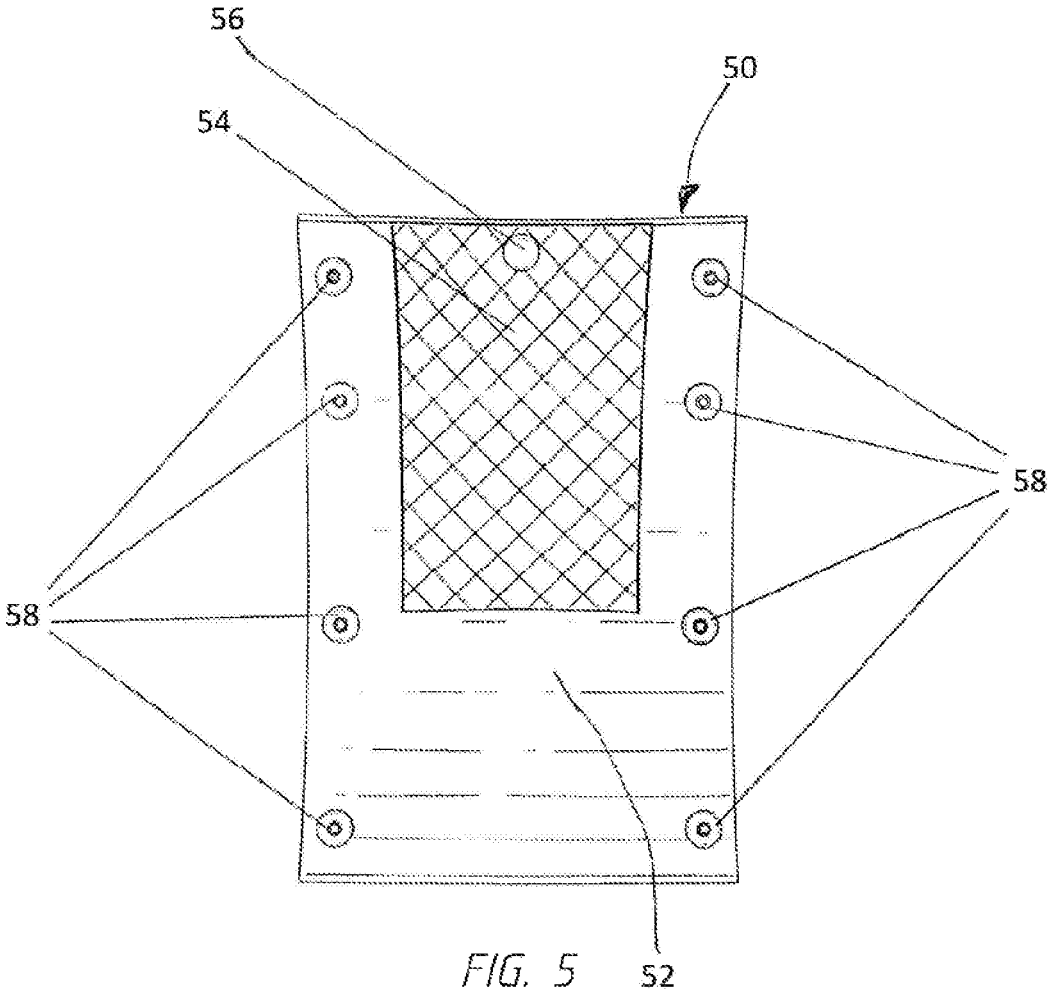
FIG. 5 depicts an underside view of another embodiment of a shoe bottom cleansing apparatus incorporating a pouch configured to abut a top surface of a shoe during intended use.

In an embodiment of the invention, a cleansing portion 52 of a shoe bottom cleansing apparatus 50 further comprises a pouch 54, as depicted in FIG. 5. In an embodiment, the pouch 54 is configured for underneath the cleansing portion 52. During one use in an embodiment, the positioning of the pouch 54 between the external surface of the cleansing portion 52 and the top of the shoe. The pouch 54 is configured generally as an enclosed pocket to hold small items such as keys or money. In an embodiment, the pouch 54 comprises mesh. In an embodiment, the pouch 54 further comprises a closure mechanism 56, such as a snap button, zipper, hook, rivet or Velcro®. In an embodiment of the invention, the pouch's 54 dimensions generally correspond to the dimensions of the cleansing portion 52. In alternative embodiments of the invention, the pouch's 54 dimensions are smaller width-wise and length-wise than the dimensions of the cleansing portion 52. In various embodiments of the invention, the pouch 54 comprises enough depth to enclose and retain folded money and three keys. In one embodiment, an attachment mechanism for the cleansing portion 52 to a shoe are snaps 58 with corresponding snap receptacles integrated into the shoe.

Figures 6A, 6B:
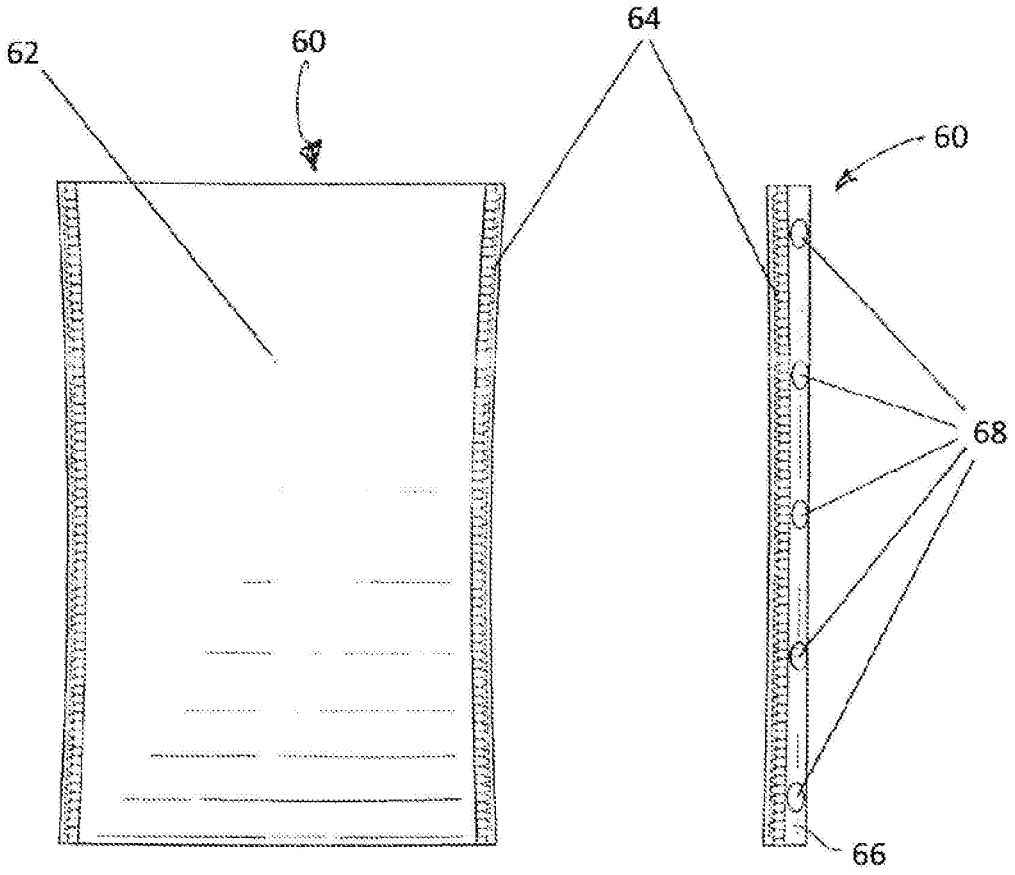
FIG. 6A depicts an embodiment of a shoe bottom cleansing apparatus incorporating a zipper connection on two edges.
FIG. 6B depicts a side view of an embodiment of a shoe bottom cleansing apparatus having a zipper shoe attachment incorporating a zipper connection on one edge and a plurality of apertures within the body of the zipper shoe attachment.

In an embodiment, one edge of a cleansing portion 62 of a shoe bottom cleansing apparatus 60 comprises a portion of a zipper 64 and one edge of a shoe attachment piece 66 comprises the corresponding portion of a zipper 64 as depicted in FIGS. 6A and 6B. In various embodiments, the affixation of the cleansing portion 62 to a shoe occurs via a strong threading capable of withstanding the forces typically placed upon the body of the shoe during athletic activity. In an embodiment, the bulk of the shoe attachment piece 66 is comprised of a piece of nylon polyester. The shoe attachment piece 66 in an embodiment is configured to comprise connection apertures 68 to allow for shoelaces to weave through the shoe attachment piece 66, as shown in FIG. 6B.

The shoe attachment piece 66 is configured in various embodiment to affix to the cleansing portion 62. In varying embodiments, the affixation of the shoe attachment piece 66 to the cleansing portion 62 takes place via rivets, buttons, Velcro®, zippers, clasps and/or hooks placed in the cleansing portion 62 and/or the shoe attachment piece 66. In an alternative embodiment, the shoe attachment piece 66 is integrated directly into the cleansing portion 62 in one unified body. In an embodiment of the invention, the shoe attachment piece's 66 dimensions measure approximately 3-6 inches in height, generally corresponding to the height of the cleansing portion 62, with a width slightly larger than the rivets, buttons, Velcro®, zippers, clasps and/or hooks integrated therein.

During an embodiment method of use, the cleansing portion 14 is placed on the top of a basketball shoe, over the laces and/or the tongue. This placement facilitates the user's ability to wipe the bottom of the user's other shoe over the cleansing portion 14 easily by raising the other shoe over the shoe containing the cleansing portion 14 while the shoe containing the cleansing portion 14 is on the floor while the user is standing. This action may be accomplished by the user without the assistance of the user's hands. The present inventor recognizes that by utilizing the shoe bottom cleansing apparatus in this manner, a user need not wait for a stoppage in gameplay and instead may briefly stop to quickly cleanse the bottom of his or her shoe while gameplay continues around him or her. The use of the shoe bottom cleansing apparatus may prolong the grip life of rubbered sole shoes, as the near-continuously available ability to cleanse the shoe may prevent debris from permanently lodging within or otherwise deforming the shape of the rubber gripping surface. In the process of retaining grip, the shoe bottom cleansing apparatus can prevent players from injuries associated with taking quick cuts on the court by improving the shoe's ability to allow its user to plant his or her feet without sliding.

Embodiments of the invention provide for the display of a customizable decorative item. In an embodiment, the customizable decorative item comprises a logo. In an embodiment, the customizable decorative item is affixed to the upper portion of the cleaning portion. In an embodiment, the customizable decorative item is removably attachable such that a user can add or remove a customization at their whim. Users will utilize the customizable decorative item to showcase an image to customize the shoes to allow them to uniquely display a logo or some other stylistic element. In a method of use associated with the invention, a user may create a design that is either integrated within the cleansing portion, or otherwise affixed to the cleansing portion to create a shoe-specific customization.

In the one embodiment, the shoe bottom cleansing apparatus is detachable. In one embodiment, the detachability of the invention is accomplished by unlacing the shoelaces from the shoe attachment piece. In an alternative embodiment, the detachability is accomplished via a zipper that creates an attachment to the shoe. In an alternative embodiment, a Velcro® surface is affixed to the underside of the cleansing surface and a corresponding Velcro® surface is attached to the upper surface of the shoe. In an alternative embodiment, the detachment is accomplished via the release of snaps. The present inventor has recognized that the detachability of the shoe bottom cleansing apparatus allows a user to quickly and easily switch out the shoe bottom cleansing apparatus for an alternative shoe bottom cleansing apparatus optionally with an alternative design or customizable decorative item. The present inventor has also recognized that the detachable nature of the shoe bottom cleansing apparatus allows a user to rapidly swap a soiled cleansing portion for a new clean cleansing portion. The present inventor has also recognized the favorable aspect of an embodiment that the detachability allows a player to have multiple options to replace a specific design for different customizations per game, for instance, to identify which team the player plays for, or alternatively to create marketing exposure for multiple items during a single game.

A further advantage associated with the preferred embodiment is that the detachable nature of the shoe bottom cleansing apparatus allows for machine washing, as well as hand washing of the shoe bottom cleansing apparatus. In the preferred embodiment, the shoe bottom cleansing apparatus is washable and therefore available for multiple uses. The method of detachment, via laces typically found on athletic shoes, allow for the shoes to safely be washed without risking damage to the shoe. Moreover, the shoe attachment piece is configured to allow the shoe bottom cleansing apparatus to fit any size shoe.

Figure 7:
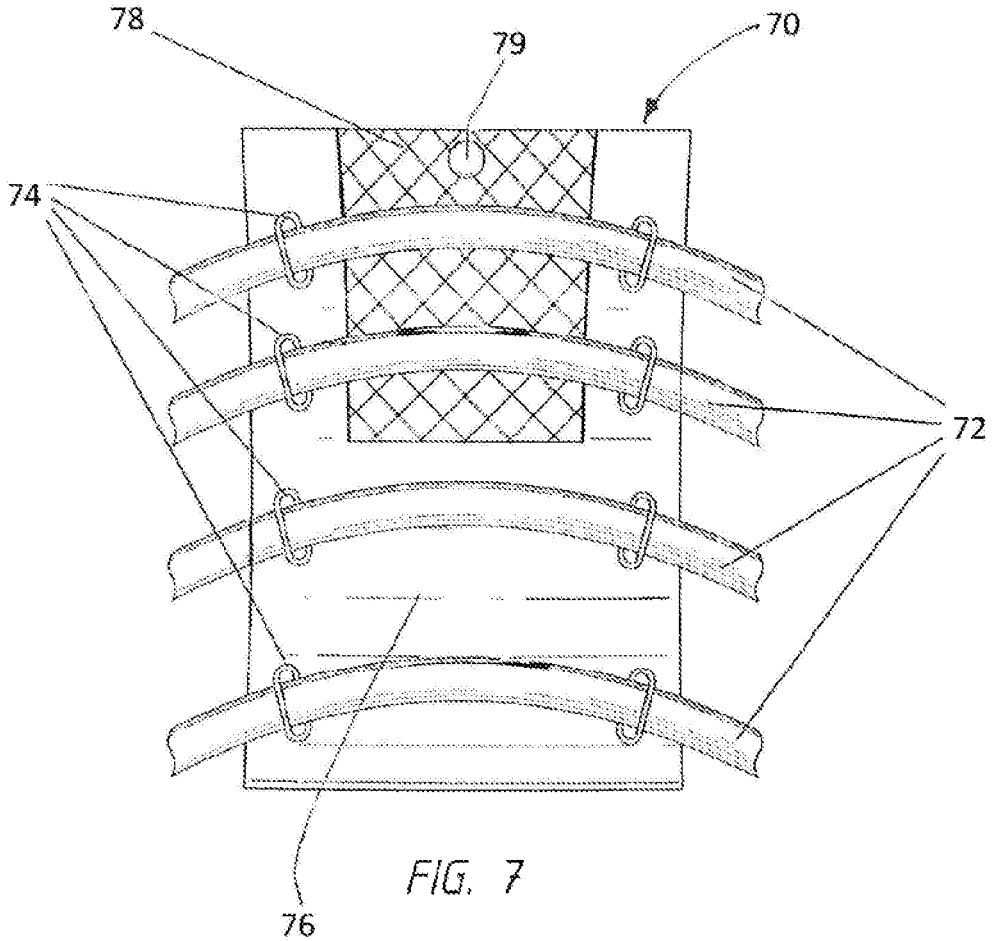
FIG. 7 depicts an underside of an embodiment of a shoe bottom cleansing apparatus featuring underside hoops configured to accommodate silicon bands

In embodiments of the invention, the shoe bottom cleaning apparatus is configured to create a closure of the shoe. In embodiments, the shoe bottom cleaning apparatus is configured such that it tightens the shoe. The cleansing portion in an embodiment is configured to keep shoes laces from becoming untied. In an embodiment, the cleansing layer provides a layer over the shoelaces during intended use, allowing the shoe laces to be tucked between the cleansing portion and the top of the shoe. In an embodiment of the invention, the shoe bottom cleansing apparatus is configured to obviate the need for shoelaces or other closures, by providing the mechanism for shoe closure itself. Referring to FIG. 7, in an embodiment of the invention, the closure action or tightening action is accomplished by the integration of silicon bands 72 configured with anchors at either end further configured to fit through and securely latch to shoelace holes of a shoe. In an embodiment, the silicon bands 72 travel through underside rings 74 affixed to the underside of a cleansing portion 76 of a shoe bottom cleansing apparatus 70, as depicted in FIG. 7. In an embodiment, the silicon bands 72 travel through both underside rings 74 and connection apertures within the cleansing portion 76 or shoe attachment piece (not shown). In such embodiment, the silicon bands 72 more securely affix the cleansing portion 76 of the shoe bottom cleansing apparatus 70 to a shoe. In one embodiment, the shoe bottom cleansing apparatus 70 having a pouch 78 further comprises a closure mechanism 79.

Figure 8:
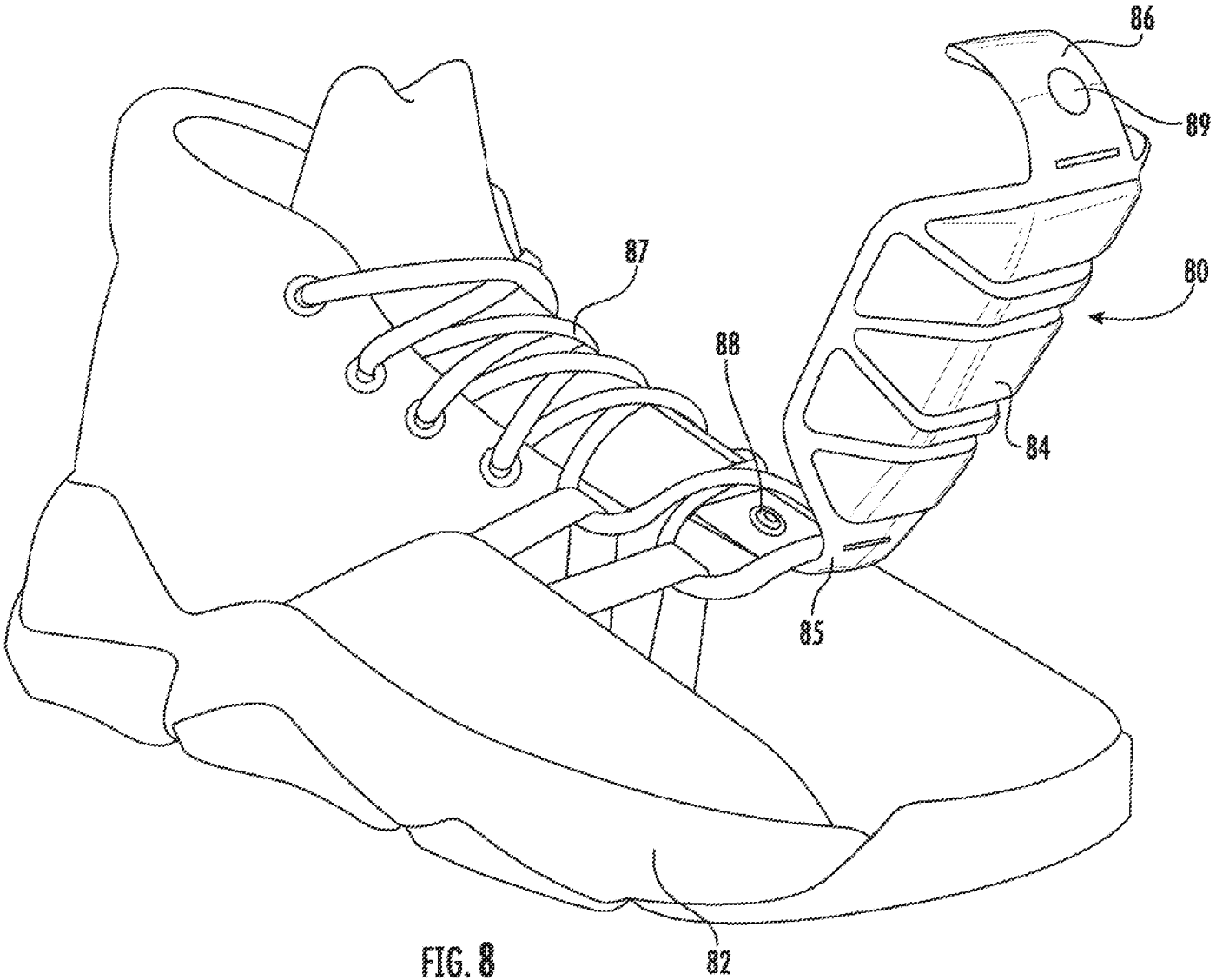
FIG. 8 depicts a perspective view of an embodiment of a shoe bottom cleansing apparatus attachable to a shoe with a snap.
Figure 8A:
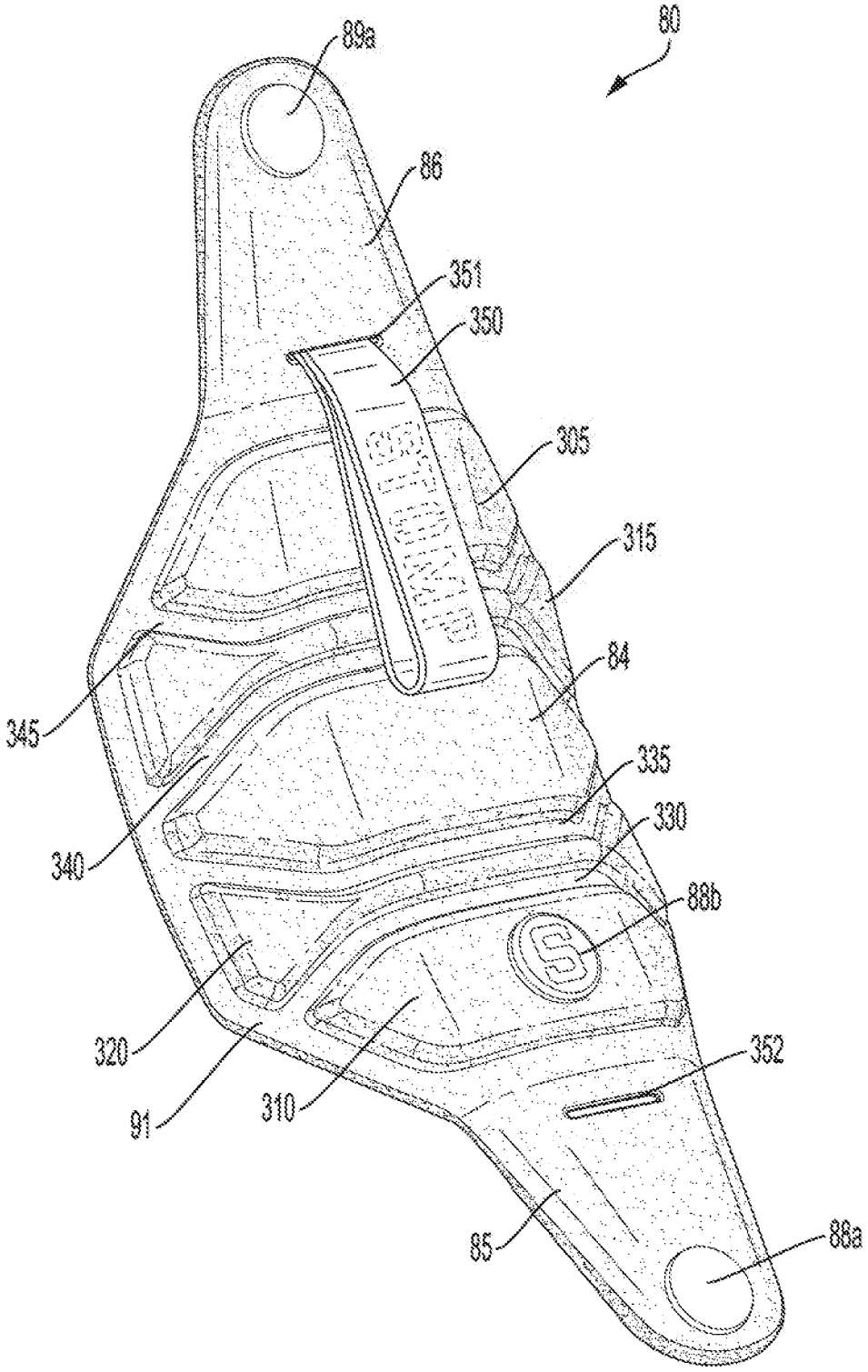
FIG. 8A depicts a perspective view of an example of the shoe bottom cleansing apparatus depicted in FIG. 8, wherein the apparatus is detached from the shoe.

Referring now to FIG. 8, another embodiment of a shoe bottom cleansing apparatus 80 is shown removably connected to a shoe 82. The shoe bottom cleansing apparatus 80 is provided with a cleansing portion 84 having a first end 85 and a second end 86. The cleansing portion 84 is configured to be positioned over the top of the shoe 82. The ends 85 and 86 are configured to wrap about laces 87 of the shoe 82. The ends 85 and 86 are provided with snap closures 88 and 89, respectively, for connecting the shoe bottom cleansing apparatus 80 to the shoe 82. In one embodiment, the shoe bottom cleansing apparatus 80 is constructed from compressed molded ethylene vinyl acetate with microfiber.

Referring to FIGS. 8A-8G, there is shown further detail of an example of the shoe bottom cleansing apparatus 80 shown in FIG. 8. As illustrated in FIGS. 8, 8A, 8B and 8G, the shoe bottom cleansing apparatus 80 may include five cleansing portions raised above a base 91. That is, the base 91 has a top surface and a bottom surface, and the cleansing portions extend from the top surface of the base 91. For example, the shoe bottom cleansing apparatus 80 may be configured to have three hexagonal-shaped cleansing portions 305, 84, 310 separated by two dumbbell-shaped or dog-boned shaped cleansing portions 315, 320. Assuming the shoe bottom cleansing apparatus 80 is attached to the laces 87 of the shoe 82, the hexagonal-shaped cleansing portion 305 is disposed at or toward the top of the laces 87, the hexagonal-shaped cleansing portion 310 is disposed at or toward the bottom of the laces 87, and the hexagonal-shaped cleansing portion 84 is disposed between the two dumbbell-shaped cleansing portions 315, 320. Hence, due to the relative orientation of the hexagonal-shaped cleansing portions to one another, the hexagonal-shaped cleansing portion 305 may be referred to as the top cleansing portion, the hexagonal-shaped cleansing portion 84 may be referred to as the middle cleansing portion, and the hexagonal-shaped cleansing portion 310 may be referred to as the bottom cleansing portion. Similarly, due to the relative orientation of the two dumbbell-shaped cleansing portions to one another, the dumbbell-shaped cleansing portion 315 may be referred to as the top intermediate cleansing portion, the dumbbell-shaped cleansing portion 320 may be referred to as the bottom intermediate cleansing portion. That is, the top intermediate dumbbell-shaped cleansing portion 315 is disposed between the top hexagonal-shaped cleansing portion 305 and the middle hexagonal-shaped cleansing portion 84, and the bottom intermediate dumbbell-shaped cleansing portion 320 is disposed between the bottom hexagonal-shaped cleansing portion 310 and the middle hexagonal-shaped cleansing portion 84.

A hexagonal-shaped cleansing portion shall mean a cleansing portion having at least six sides. More specifically, a hexagonal-shaped cleansing portion may have an irregular hexagon shape. For example, the hexagonal-shaped cleansing portion 84 has a first parallel side 84*b*, connected to and extending in opposite directions to a first tapered side 84*a* and a second tapered side 84*c*. The hexagonal-shaped cleansing portion 84 also has a second parallel side 84*e*, connected to and extending in an opposite direction to a third diagonal side 84*d* and a fourth diagonal side 84*f*. The first parallel side 84*b* and the second parallel side 84*e* are parallel to one another. The lengths of the first parallel side 84*b* and the second parallel side 84*e* may be about equal to one another. The term "about" is understood as including a stated value within ±10 percent. For example, the lengths of the first parallel side 84*b* and the second parallel side 84*e* may be between about 10 to 50 millimeters (mm), including any increment therebetween, such as about 30 mm. The lengths of the first diagonal side 84*a*, the second diagonal side 84*c*, the third diagonal side 84*d* and the fourth diagonal side 84*f* may be about equal to another. For example, the lengths of the first diagonal side 84*a*, the second diagonal side 84*c*, the third diagonal side 84*d* and the fourth diagonal side 84*f* may be between about 10 mm to 20 mm, including any increment therebetween, such as about 15 mm.

The first diagonal side 84*a* and the second diagonal side 84*c* extend at an angle of between about 25 to 45 degrees, such as 35 degrees, from opposite ends of the first parallel side 84*b*, wherein the angle is measured between the longitudinal axis of the first parallel side 84*b* and both (1) the first diagonal side 84*a* and (2) the second diagonal side 84*c*. Similarly, the third diagonal side 84*d* and the fourth diagonal side 84*f* extend an angle of between about 25 to 45 degrees, such as 35 degrees, from opposite ends of the second parallel side 84*e*, wherein the angle is measured between the longitudinal axis of the second parallel side 84*e* and both (1) the third diagonal side 84*d* and (2) the fourth diagonal side 84*f*.

Because the lengths of the parallel sides are the same, the lengths of the diagonal sides are the same, and the tapered angles are the same for the diagonal sides, the hexagonal-shaped cleansing portion 84 is symmetrical. A hexagonal-shaped cleansing portion, however, does not need to be symmetrical. For example, neither the top hexagonal-shaped cleansing portion 305 nor the bottom hexagonal-shaped cleansing portion 310 are symmetrical. The hexagonal-shaped cleansing portion 305 has a first parallel side 305*b*, connected to and extending in opposite directions to a first diagonal side 305*a* and a second diagonal side 305*c*. The hexagonal-shaped cleansing portion 305 also has a second parallel side 305*e*, connected to and extending in opposite directions to a third diagonal side 305*d* and a fourth diagonal side 305*f*. The first parallel side 305*b* and the second parallel side 305*e* are parallel to one another. The lengths of the first parallel side 305*b* and the second parallel side 305*e* are equal to one another. For example, the lengths of the first parallel side 305*b* and the second parallel side 305*e* may be between about 20 mm to 40 mm, including any increment therebetween, such as about 30 mm. The lengths of the first diagonal side 305*a*, the second diagonal side 305*c*, the third diagonal side 305*d* and the fourth diagonal side 305*f* are not all equal to another. The lengths of the first diagonal side 305*a* and the second diagonal side 305*c* are equal to one another, and the lengths of the third diagonal side 305*d* and the fourth diagonal side 305*f* are equal to one another. For example, the lengths of the first diagonal side 305*a* and the second diagonal side 305*c* may be equal to between about 7.5 mm to 12.5 mm, such as about 10 mm or 10.5 mm, and the lengths of the third diagonal side 305*d* and the fourth diagonal side 305*f* may be equal to between about 5 mm to 10 mm, such as about 7.5 mm. Also, the first diagonal side 84*a* and the second diagonal side 84*c* extend at an angle of between about 45 to 65 degrees, such as about 55 degrees, from opposite ends of the first parallel side 305*b*, wherein the angle is measured from the longitudinal axis of the first parallel side 305*b* and both (1) the first diagonal side 305*a* and (2) the second diagonal side 305*c*. Similarly, the third diagonal side 305*d* and the fourth diagonal side 305*f* extend at an angle of between about 25 to 45 degrees, such as about 35 degrees, from opposite ends of the second parallel side 305*e*, wherein the angle is measured from the longitudinal axis of the second parallel side 305*e* and both (1) the third diagonal side 305*d* and (2) the fourth diagonal side 305*f*.

The hexagonal-shaped cleansing portion 310 has a first parallel side 310*b*, connected to and extending in opposite direction to a first diagonal side 310*a* and a second diagonal side 310*c*. The hexagonal-shaped cleansing portion 310 also has a second parallel side 310*e*, connected to and extending in opposite direction to a third diagonal side 310*d* and a fourth diagonal side 310*f*. The first parallel side 310*b* and the second parallel side 310*e* are parallel to one another. The lengths of the first parallel side 310*b* and the second parallel side 310*e* are equal to one another. For example, the lengths of the first parallel side 310*b* and the second parallel side 310*e* may be between about 20 mm to 40 mm, including any increment therebetween, such as about 30 mm. The lengths of the first diagonal side 310*a*, the second diagonal side 310*c*, the third diagonal side 310*d* and the fourth diagonal side 310*f* are not all equal to another. The lengths of the first diagonal side 310*a* and the second diagonal side 310*c* are equal to one another, and the lengths of the third diagonal side 310*d* and the fourth diagonal side 310*f* are equal to one another. For example, the lengths of the first diagonal side 310*a* and the second diagonal side 310*c* may between about 5 mm to 10 mm, such as about 7.5 mm, and the lengths of the third diagonal side 310*d* and the fourth diagonal side 310*f* may be between about 7.5 mm to 12.5 mm, such as about 10 mm or 10.5 mm. Also, the first diagonal side 84*a* and the second diagonal side 84*c* extend at an angle between about 25 to 45 degrees, such as about 35 degrees, from opposite ends of the first parallel side 310*b*, wherein the angle is measured from the longitudinal axis of the first parallel side 310*b* and (1) the first diagonal side 310*a* and (2) the second diagonal side 310*c*. Similarly, the third diagonal side 310*d* and the fourth diagonal side 310*f* extend at an angle of between about 25 to 45 degrees, such as about 35 degrees, from opposite ends of the second parallel side 310*e*, wherein the angle is measured from the longitudinal axis of the second parallel side 310*e* and (1) the third diagonal side 310*d* and (2) the fourth diagonal side 310*f*.

As mentioned above, a hexagonal-shaped cleansing portion shall mean a cleansing portion having at least six sides. For the purposes of this disclosure, a hexagonal-shaped cleansing portion shall include a cleansing portion having a polygon with six sides that expand across the substantial majority of the width e of the shoe cleaning apparatus. For example, the hexagonal-shaped cleansing portion 84 has two ends or sides 84*h*, 84*i*, wherein the end 84*h* connects the second diagonal side 84*c* to the third diagonal side 84*d*, and the end 84*i* connects the first diagonal side 84*a* to the fourth diagonal side 84*f*, thereby closing the polygon. The two ends or sides 84*h*, 84*i* are also generally parallel to one another and substantially perpendicular to the first parallel side 84*b* and the second parallel side 84*e*.

As mentioned above and as shown in FIGS. 8A and 8B, the top intermediate dumbbell-shaped cleansing portion 315 is disposed between the top hexagonal-shaped cleansing portion 305 and the middle hexagonal-shaped cleansing portion 84, and the bottom intermediate dumbbell-shaped cleansing portion 320 is disposed between the bottom hexagonal-shaped cleansing portion 310 and the middle hexagonal-shaped cleansing portion 84. Referring to FIG. 8C, the top intermediate dumbbell-shaped cleansing portion 315 has a left area 317 and a right area 321 connected by a bar 319. The left area 317 and right area 321 each have a generally triangular shape to complement the shapes of the top hexagonal-shaped cleansing portion 305 and the middle hexagonal-shaped cleansing portion 84. For example, the left area 317 is formed by a first diagonal side 315*a*, a second diagonal side 315*g* (and optionally a third side 315*i*) and an end side 315*h*, wherein the end side 315*h* is perpendicular to the longitudinal axis of the bar 319. Similarly, the right area 321 is formed by a first diagonal side 315*c*, a second diagonal side 315*e* (and optionally a third side 315*j*) and an end side 315*d*, wherein the end side 315*d* is perpendicular to the longitudinal axis of the bar 319. The left area 317 and the right area 321 are mirror images of one another. The bar 319 is formed by a first parallel side 315*b* and a second parallel side 315*f*, wherein the first parallel side 315*b* and the second parallel side 315*f* are parallel to one another. The first parallel side 315*b* and the second parallel side 315*f* of the top intermediate dumbbell-shaped cleansing portion 315 have the same or substantially similar lengths of the first parallel side 305*b* and the second parallel side 305*e* of the middle hexagonal-shaped cleansing portion 84 because the shapes of the dumbbell-shaped cleansing portions 315, 320 are adjacent to and complement the hexagonal-shaped cleansing portions 84, 305, 310. As such, the lengths of the diagonal sides 315*a*, 315*g*, 315*e*, 315*g* of the dumbbell-shaped cleansing portion 315 are the same or similar to the lengths of the diagonal sides 84*a*, 84*c*, 84*d*, 84*f* of the hexagonal-shaped cleansing portion 84 or the other hexagonal-shaped cleansing portions 305, 310. If the dumbbell-shaped cleansing portion 315 has additional diagonal sides 315*i*, 315*j*, then those additional sides may have lengths less the diagonal sides 315*a*, 315*g*, 315*e*, 315*g*, and diagonal sides 315*a*, 315*g*, 315*e*, 315*g* may not be equal to one another.

Figure 8B:
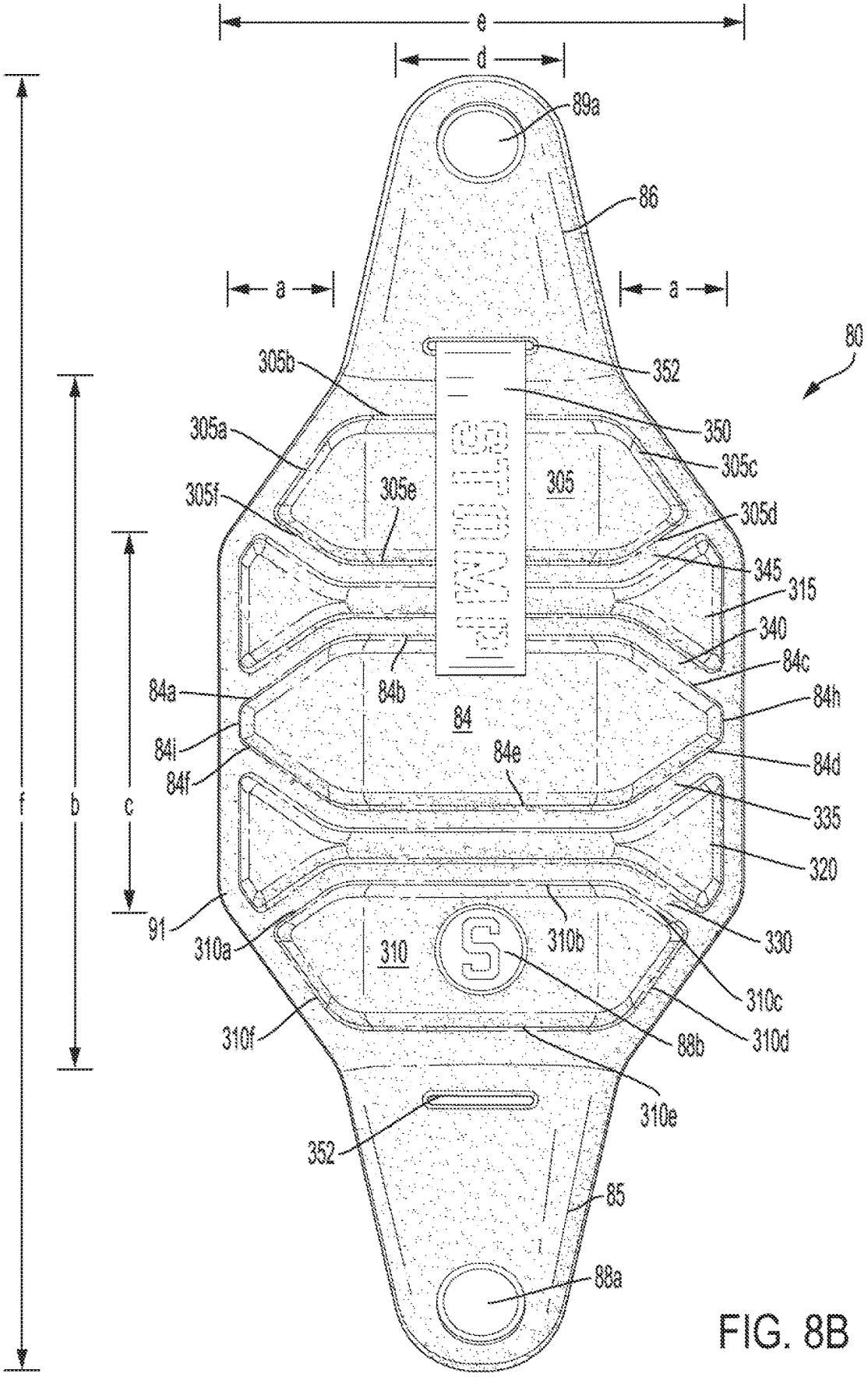
FIG. 8B depicts a top view of the shoe bottom cleansing apparatus depicted in FIG. 8A, wherein the apparatus is detached from the shoe.
Figure 8C:
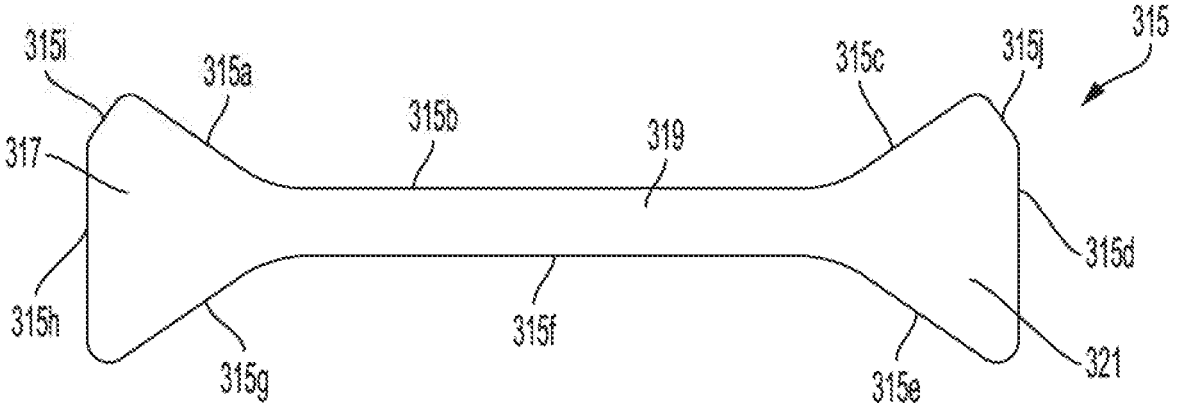
FIG. 8C depicts an enlarged view of the top intermediate dumbbell-shaped cleansing portion shown in FIGS. 8A and 8B.
Figure 8D:
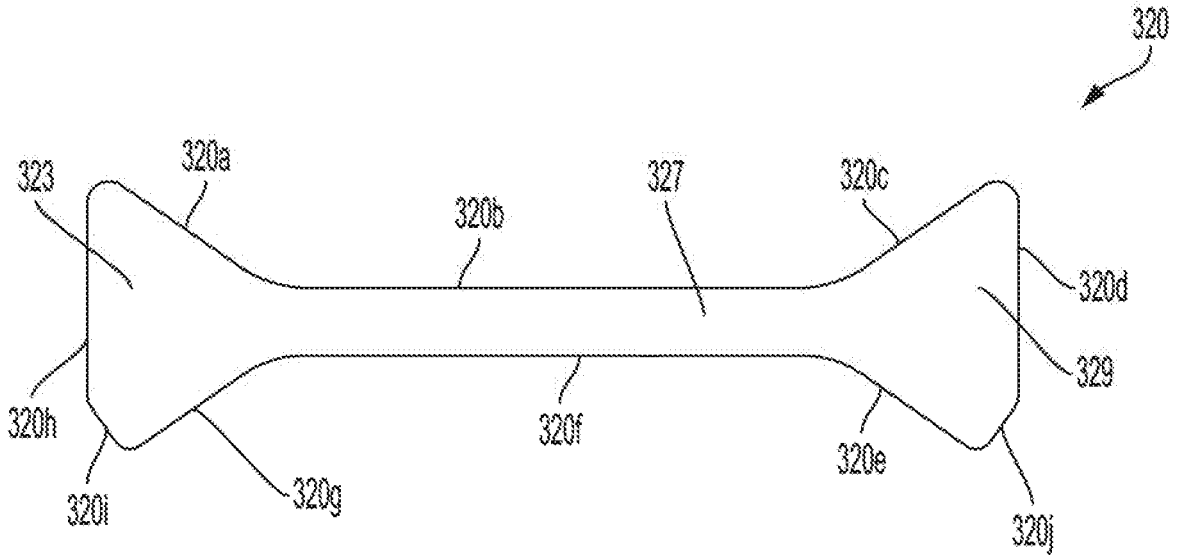
FIG. 8D depicts an enlarged view of the bottom intermediate dumbbell-shaped cleansing portion shown in FIGS. 8A and 8B.

Referring to FIG. 8D, the bottom intermediate dumbbell-shaped cleansing portion 320 has a left area 323 and a right area 329 connected by a bar 327. The left area 323 and right area 329 each have a generally triangular shape to complement the shapes of the bottom hexagonal-shaped cleansing portion 310 and the middle hexagonal-shaped cleansing portion 84. For example, the left area 323 is formed by a first diagonal side 320*a*, a second diagonal side 320*g* (and optionally a third side 320*i*) and an end side 320*h*, wherein the end side 320*h* is perpendicular to the longitudinal axis of the bar 327. Similarly, the right area 329 is formed by a first diagonal side 320*c*, a second diagonal side 320*e* (and optionally a third side 320*j*) and an end side 320*d*, wherein the end side 320*d* is perpendicular to the longitudinal axis of the bar 327. The left area 323 and the right area 329 are mirror images of one another. The bar 327 is formed by a first parallel side 320*b* and a second parallel side 320*f*, wherein the first parallel side 320*b* and the second parallel side 320*f* are parallel to one another. The first parallel side 320*b* and the second parallel side 320*f* of the bottom intermediate dumbbell-shaped cleansing portion 320 have the same or substantially similar lengths of the first parallel side 84*b* and the second parallel side 84*e* of the middle hexagonal-shaped cleansing portion 84 because the shapes of the dumbbell-shaped cleansing portions 315, 320 are adjacent to and complement the hexagonal-shaped cleansing portions 84, 305, 310. As such, the lengths of the diagonal sides 320*a*, 320*c*, 320*e*, 320*g* of the dumbbell-shaped cleansing portion 320 are the same or similar to the lengths of the diagonal sides 84*a*, 84*c*, 84*d*, 84*f* of the hexagonal-shaped cleansing portion 84 or the other hexagonal-shaped cleansing portions 305, 310. If the dumbbell-shaped cleansing portion 320 has additional diagonal sides 320*i*, 320*j*, then those additional sides may have lengths less the diagonal sides 320*a*, 320*c*, 320*e*, 320*g*, and diagonal sides 320*a*, 320*c*, 320*e*, 320*g* may not be equal to one another.

Continuing to refer to FIGS. 8A-8D, the left areas 317. 323 and the right areas 321, 329 of the top intermediate dumbbell-shaped cleansing portion 315 and the bottom intermediate dumbbell-shaped cleansing portion 320 are generally triangular shaped because the diagonal sides 315*a*, 315*g*, 315*c*, 315*e* of the top intermediate dumbbell-shaped cleansing portion 315 and the diagonal sides 320*a*, 320*g*, 320*c*, 320*e* of the bottom intermediate dumbbell-shaped cleansing portion 320 diverge as the diagonal sides extend away from the bars 319, 327 and towards the end sides 315*h*, 315*d*, 320*h*, 320*d* of the top intermediate dumbbell-shaped cleansing portion 315 and the bottom intermediate dumbbell-shaped cleansing portion 320, respectively. That is, each of the sides are flat and the aggregated sides form complementary shapes. Because the shapes of the dumbbell-shaped cleansing portions 315, 320 are adjacent to and complement the hexagonal-shaped cleansing portions 84, 305, 310, the diagonal sides 84*a*, 305*a*, 310*a*, 84*f*, 305*f*, 310*f*, 84*c*, 305*c*, 310*c*, 84*d*, 305*d*, 310*d* of the hexagonal-shaped cleansing portions 84, 305, 310 also form generally triangular shaped complementary to the left areas 317, 323 and the right areas 321, 329 of the top intermediate dumbbell-shaped cleansing portion 315 and the bottom intermediate dumbbell-shaped cleansing portion 320. But the diagonal sides 84*a*, 305*a*, 310*a*, 84*f*, 305*f*, 310*f*, 84*c*, 305*c*, 310*c*, 84*d*, 305*d*, 310*d* of the hexagonal-shaped cleansing portion 84, 305, 310 converge as the diagonal sides extend away from the first and second parallel sides 84*b*, 84*e*, 305*a*, 305*e*, 310*a*, 310*e* of the hexagonal-shaped cleansing portions 84, 305, 310. That is, the generally triangular-shaped areas of the hexagonal-shaped cleansing portions 84, 305, 310 and the intermediate dumbbell-shaped cleansing portions 315, 320 face different directions because they are complementary to one another. The hexagonal-shaped cleansing portions and the intermediate dumbbell-shaped cleansing portions may have other complementary shapes. For example, the sides of the cleansing portions may both have a zig-zag or sinusoidal or S-shaped sides to engage and complement one another. Additionally, one of the cleansing portions may be circular shaped, and at least a portion of the other cleansing portion may have an arc shape.

Referring again to FIGS. 8, 8A and 8B, the hexagonal-shaped cleansing portions 305, 84, 310 may be separated by dumbbell-shaped or dog-boned shaped cleansing portions 315, 320. The hexagonal-shaped cleansing portions 305, 84, 310 and the dumbbell-shaped or dog-boned shaped cleansing portions 315, 320 are raised above a base 91, and the spacing between the hexagonal-shaped cleansing portions 305, 84, 310 and the dumbbell-shaped cleansing portions 315, 320 create(s) grooves. For example, groove 330 is created between the bottom dumbbell-shaped cleansing portion 320 and the bottom hexagonal-shaped cleansing portion 310; groove 335 is created between the bottom dumbbell-shaped cleansing portion 320 and the middle hexagonal-shaped cleansing portion 84; groove 335 is created between the middle hexagonal-shaped cleansing portion 84 and the bottom dumbbell-shaped cleansing portion 320; groove 340 is created between the top dumbbell-shaped cleansing portion 315 and the middle hexagonal-shaped cleansing portion 84; and groove 345 is created between the top hexagonal-shaped cleansing portion 305 and the top dumbbell-shaped cleansing portion 315. The widths of some or all of the grooves 330, 335, 340, 345 may be the same or different. The widths of some or all of the lengths of the grooves 330, 335, 340, 345 may be constant or vary. For example, the widths of some or all of the grooves 330, 335, 340, 345 may be between about 1 mm to 5 mm including any increment therebetween, such as about 3 mm.

Referring to FIGS. 8A, 8B, 8E, 8F and 8G, base 91 of the shoe bottom cleansing apparatus 80 extends from the first end 85 to the second end 86. In an unsnapped configuration, the length f of the shoe bottom cleansing apparatus 80 extending from the most distal point of the first end 85 to most distal point of the second end 86 may be between about 200 mm to 400 mm, including any value therebetween, such as about 245 mm, 250 mm, 255 mm, 260 mm, 265 mm, 270 mm, 275 mm, 280 mm, 285 mm, 290 mm, 300 mm, 305 mm, 310 mm, 315 mm 320 mm, 325 mm, 330 mm, 335 mm, 340 mm, 345 mm, 350 mm and 355 mm. The base 91 has a central section that has a length b, which extends longitudinally from the first end 85 to the second end 86 in FIG. 8B. For example, length b may be between about 70 mm to 90 mm or any increment therebetween, such as about 78, 79, 80, 81 or 82 mm. The intersections of the central section and the folds when the first end 85 and the second end 86 are wrapped under the laces 87 and snapped together via the snaps. Specifically, the first end 85 comprises a snap 88*a*, and the bottom hexagonal-shaped cleansing portion 310 comprises a snap 88*b*; so, when the first end 85 folds along the intersection with the central section, the first end 85 is located under the bottom hexagonal-shaped cleansing portion 310 and the snaps 88*a*, 88*b* are matingly engaged. Similarly, the second end 86 comprises a snap 89*b*, and the top hexagonal-shaped cleansing portion 305 comprises a snap 89*a*; so, when the second end 86 folds along the intersection with the central section, the second end 86 is located under the top hexagonal-shaped cleansing portion 305 and the snaps 89*a*, 89*b* are matingly engaged.

Referring to FIGS. 8A, 8B, 8F and 8G, there are depicted slots 351, 352 disposed within the first end 85 and the second end 86, respectively. The slots 351, 352 allow for inserting and passing therethrough a loop 350 or other ornamental item. The loop 350 also allows the wearer of the apparatus a component upon which to grasp or to pull when attaching or removing the apparatus from the shoe. As shown in these figures, the loop 350 passes trough the slot 351 such that a portion of the loop 350 is exposed on the top surface of the apparatus, and a portion of the loop 350 is exposed to the bottom surface of the apparatus. One end of the loop 350 is attached to the bottom surface via the snap 89*a*. That is, one end of the loop 350 is fixedly coupled to the base 91 and disposed between the snap 89 and the bottom surface of the base 91. And the other end of the loop 350 is freely disposed on top surface of the apparatus. Although the figures only depict one loop 350 inserted through slot 351, it is envisioned that another or an alternative loop may be inserted through slot 352 and be attached to snap 88*b*.

Figure 8E:
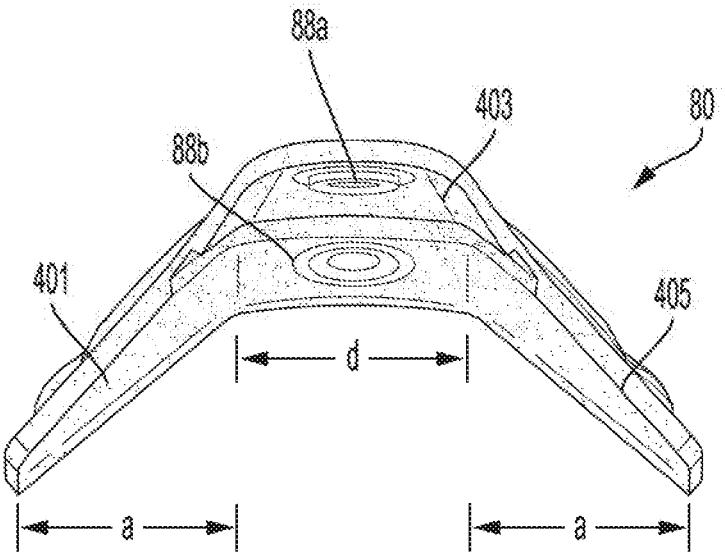
FIG. 8E depicts an end view of the shoe bottom cleansing apparatus depicted in FIG. 8A, wherein the apparatus is detached from the shoe.
Figure 8F:
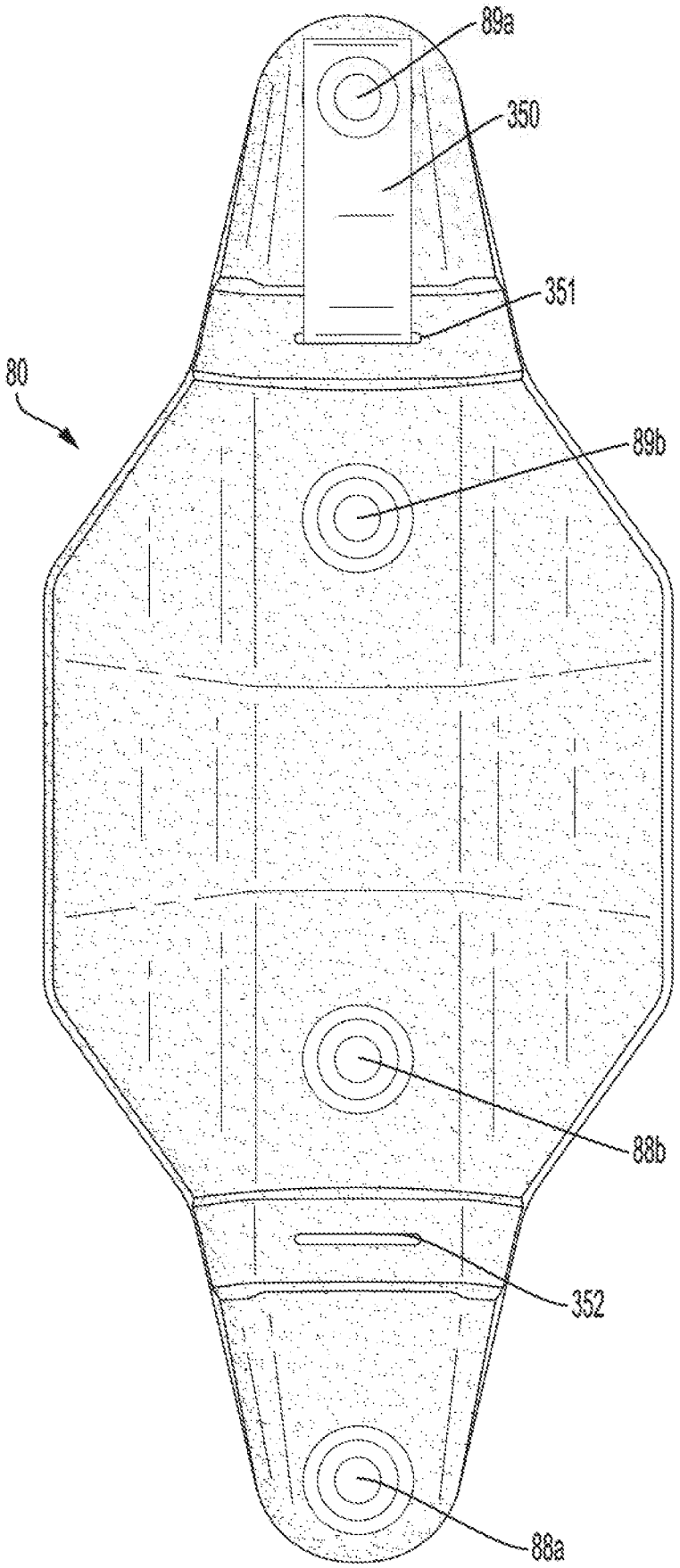
FIG. 8F depicts a bottom view of the shoe bottom cleansing apparatus depicted in FIG. 8A, wherein the apparatus is detached from the shoe.
Figure 8G:
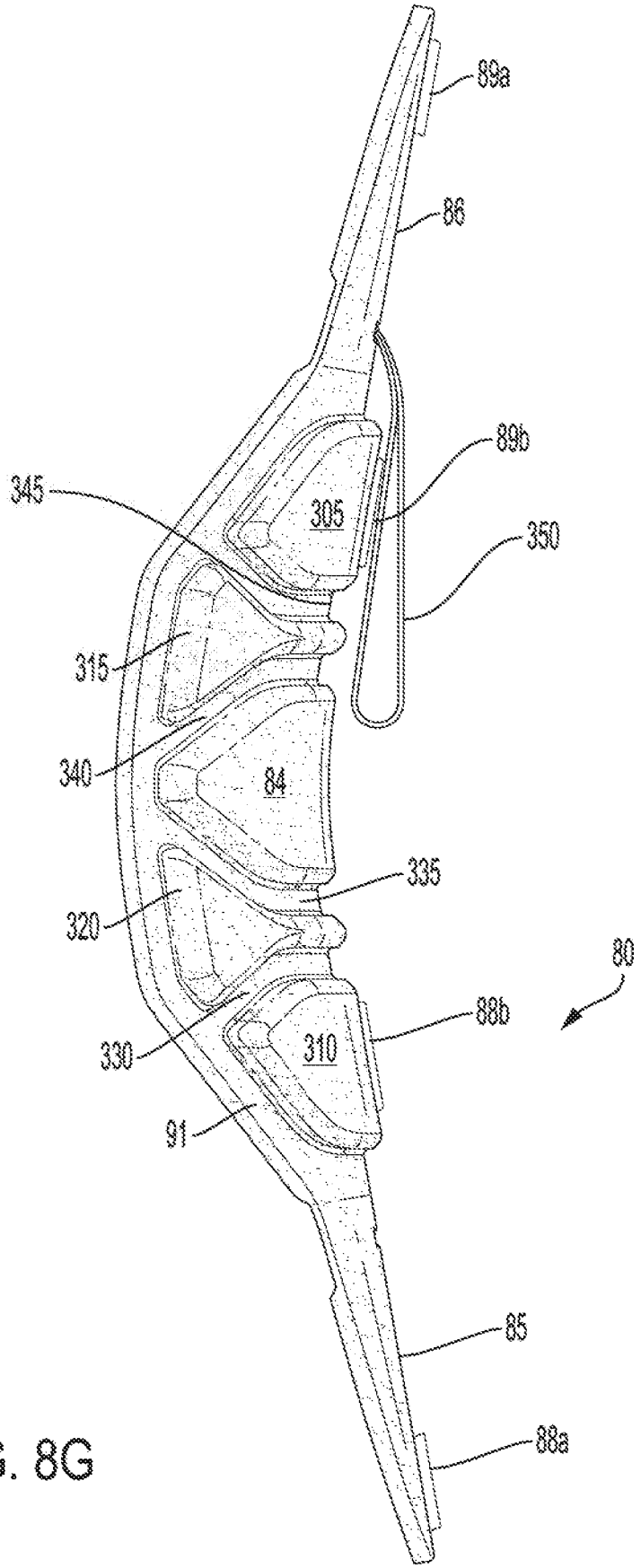
FIG. 8G depicts a side view of the shoe bottom cleansing apparatus depicted in FIG. 8A, wherein the apparatus is detached from the shoe.

Referring to FIGS. 8B, 8E and 8F, the central section has a length b, which extends longitudinally from the proximal ends of the first end 85 and the second end 86. The width of the central section extends laterally across the shoe bottom cleansing apparatus 80. The width of the central section begins at width e for a length c of the central section, and the width of the central section decreases and tapers to width d as the central section extends from length c to length b. For example, length b may be between about 70 mm to 90 mm, and width e may be between about 50 mm to 70 mm or any increment therebetween, such as about 68, 69, 70, 71 or 72 mm. And length c may be between about 30 mm to 50 mm or any increment therebetween, such as about 38, 39, 40, 41 or 42 mm. The base 91 also has a left wing portion having a width a, a middle portion having a width d, and a right wing portion having a width a. For example, width a may be between about 10 mm to 20 mm or any increment therebetween, such as about 13, 14, 15, 16, or 17 mm, and width d may be between about 10 mm to 30 mm or any increment therebetween, such as about 18, 19, 20, 21, or 22 mm. The length of the middle portion is b. The left wing portion begins with length c and increases to length b as it tapers inwardly toward the longitudinal axis of the shoe cleansing apparatus. Similarly, the right wing portion begins with length c and increases to length b as it tapers inwardly toward the longitudinal axis of the shoe cleansing apparatus.

The shoe bottom cleansing apparatus 80 is configured such that the left wing portion and right wing portion bend downwardly, as illustrated in FIG. 8E. The shoe bottom cleansing apparatus 80 is configured such that (a) the left areas 317, 323 of the top intermediate dumbbell-shaped cleansing portion 315 and the bottom intermediate dumbbell-shaped cleansing portion 320 are substantially disposed on the left wing, (b) the right areas 321, 329 of the top intermediate dumbbell-shaped cleansing portion 315 and the bottom intermediate dumbbell-shaped cleansing portion 320 are substantially disposed on the right wing, and (c) the bars 319, 323 of the top intermediate dumbbell-shaped cleansing portion 315 and the bottom intermediate dumbbell-shaped cleansing portion 320 are substantially disposed on the central section. For example, substantially disposed on the central section shall mean that the majority of the relevant area or component is disposed on the central section; the ends of the bars 319, 323 of the top intermediate dumbbell-shaped cleansing portion 315 and the bottom intermediate dumbbell-shaped cleansing portion 320 may be disposed on the left areas 317, 323 and/or the right areas 321, 329, but the bars 319, 327 are predominantly disposed on the central section.

The shoe bottom cleansing apparatus 80 is configured such that the hexagonal-shaped cleansing portions 84, 305, 310 have (a) the first diagonal sides 84*a*, 305*a*, 315*a* and fourth diagonal sides 84*f*, 305*f*, 315*f* are substantially disposed on the left wing, (b) the first parallel sides 84*b*, 305*b*, 310*b* and the second parallel sides 84*e*, 305*e*, 315*e* are substantially disposed on the central section, and (c) the second diagonal sides 84*c*, 305*c*, 315*c* and third diagonal sides 84*d*, 305*d*, 315*d* are substantially disposed on the right wing. Stated differently, (a) the first diagonal sides 84*a*, 305*a*, 315*a* and fourth diagonal sides 84*f*, 305*f*, 315*f* form generally triangularly shaped areas within the hexagonal-shaped cleansing portions, and the generally triangularly shaped areas are substantially disposed on the left wing, (b) the first parallel sides 84*b*, 305*b*, 310*b* and the second parallel sides 84*e*, 305*e*, 315*e* define generally rectangularly shaped areas within the hexagonal-shaped cleansing portions 84, 305, 310 and the generally rectangularly shaped areas are substantially disposed on the central section, and (c) the second diagonal sides 84*c*, 305*c*, 315*c* and third diagonal sides 84*d*, 305*d*, 315*d* form generally triangularly shaped areas within the hexagonal-shaped cleansing portions, and the generally triangularly shaped areas are substantially disposed are substantially disposed on the right wing.

As mentioned above, the shoe bottom cleansing apparatus 80 is constructed from compressed molded ethylene vinyl acetate (EVA) surrounded by a fabric, such as a microfiber. The thickness of the EVA is between about 1 mm to 3 mm or any increment therebetween, such as about 2 mm, at the base 91 and between about 2 mm to 6 mm, such as about 4 mm, at hexagonal-shaped cleansing portions 84, 305, 310 and the top intermediate dumbbell-shaped cleansing portions 315, 320, wherein the thickness of the EVA is greater at the at hexagonal-shaped cleansing portions 84, 305, 310 and the top intermediate dumbbell-shaped cleansing portions 315, 320 in comparison to the thickness of the EVA at the base 91. The EVA has a hardness of Shore 30 to Shore 70 (on a Shore A scale), including any value therebetween, such as Shore 35, 40, 45, 50, 55, 60 and 65 (one a Shore A scale). As mentioned above, EVA is a material capable of being compressed molded. Other compression molding materials that may be used to create the device include cross-linked foams, polyvinyl chloride (PVC) foams, open cell urethanes, fabrics and thermoplastic urethane films.

As mentioned above, the compression molded material is surrounded by a fabric, such as a microfiber. The fabric may be laminated to the fabric with an adhesive. Although it is not shown in the drawings, the fabric may include stitching around the perimeter of the shoe bottom cleansing apparatus 80 in order to increase the adherence of the fabric to the EVA. Additionally, the bottom side of the shoe bottom cleansing apparatus 80 may include silicone or some type of adhesive around its perimeter to increase friction between the shoe bottom cleansing apparatus 80 and the shoe and thereby minimize movement of the shoe bottom cleansing apparatus 80 relative to the shoe.

Constructing the shoe bottom cleansing apparatus 80 of compression molded material, surrounding the compression molded material with a fabric, and configuring the shoe bottom cleansing apparatus 80 as described in this disclosure, such as the size and shape of its different portions, provides the shoe bottom cleansing apparatus 80 with various commercially desirable features, including being light weight, highly durable, the ability to hold a specific form thereby allowing the apparatus to conform to a shoe profile, capable of flexing without breaking or tearing, absorbent so pressure from other foot does not add substantial pressure to the top of the foot to which the apparatus is attached during use, resilient even after long-term use and machine washable.

Figure 10:
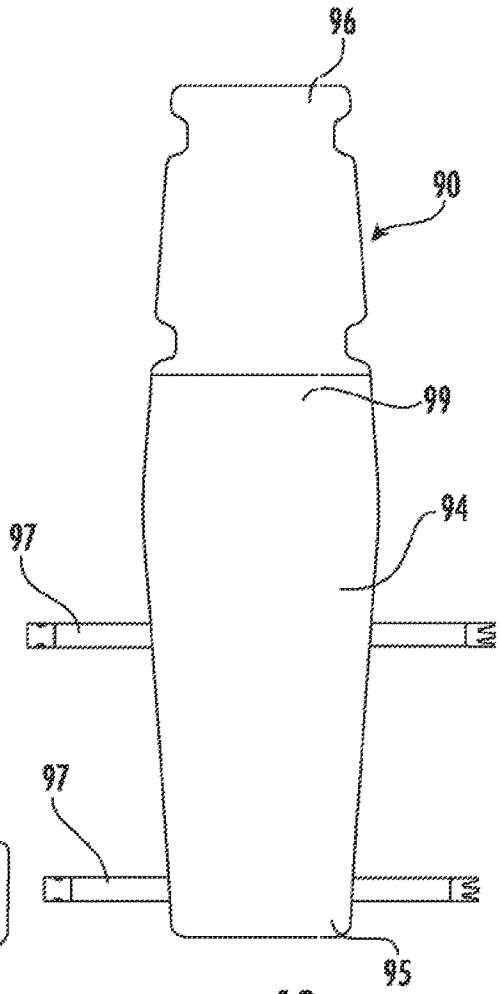
FIG. 10 depicts the shoe bottom cleansing apparatus of FIG. 9.
Figure 9:
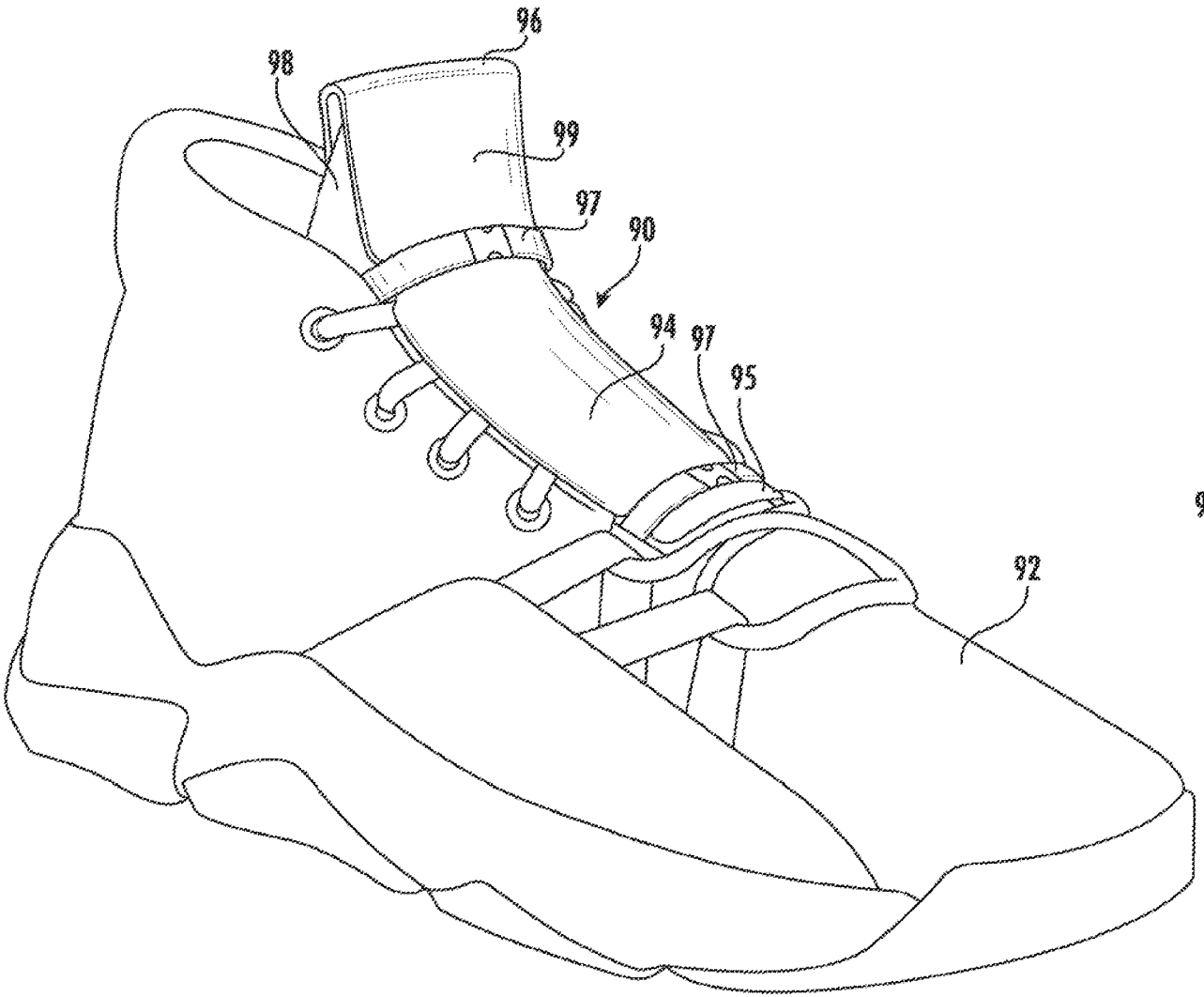
FIG. 9 depicts another embodiment of a shoe bottom cleansing apparatus attachable to a shoe with a plurality of buckles.

Now referring to FIGS. 9-10, an embodiment of a shoe bottom cleansing apparatus 90 is shown connected to a shoe 92. The shoe bottom cleansing apparatus 90 is provided with a cleansing portion 94 having a first end 95 and a second end 96. The cleansing portion 94 is configured to be positioned over the top of the shoe 92. A plurality of buckles 97 are provided extending from a portion of the cleansing portion 94 for connecting the shoe bottom cleansing apparatus 90 about the tongue 98 of the shoe 92. The second end 96 is configured to wrap about a portion of the tongue 98 of the shoe 92 to assist in connecting the show bottom cleansing apparatus 90 to the shoe 92. In one embodiment, the shoe bottom cleansing apparatus 90 is provided with a platform 99 for placing a brand, team logo or other names, logos, art, words, etc., as so desired.

Figure 11:
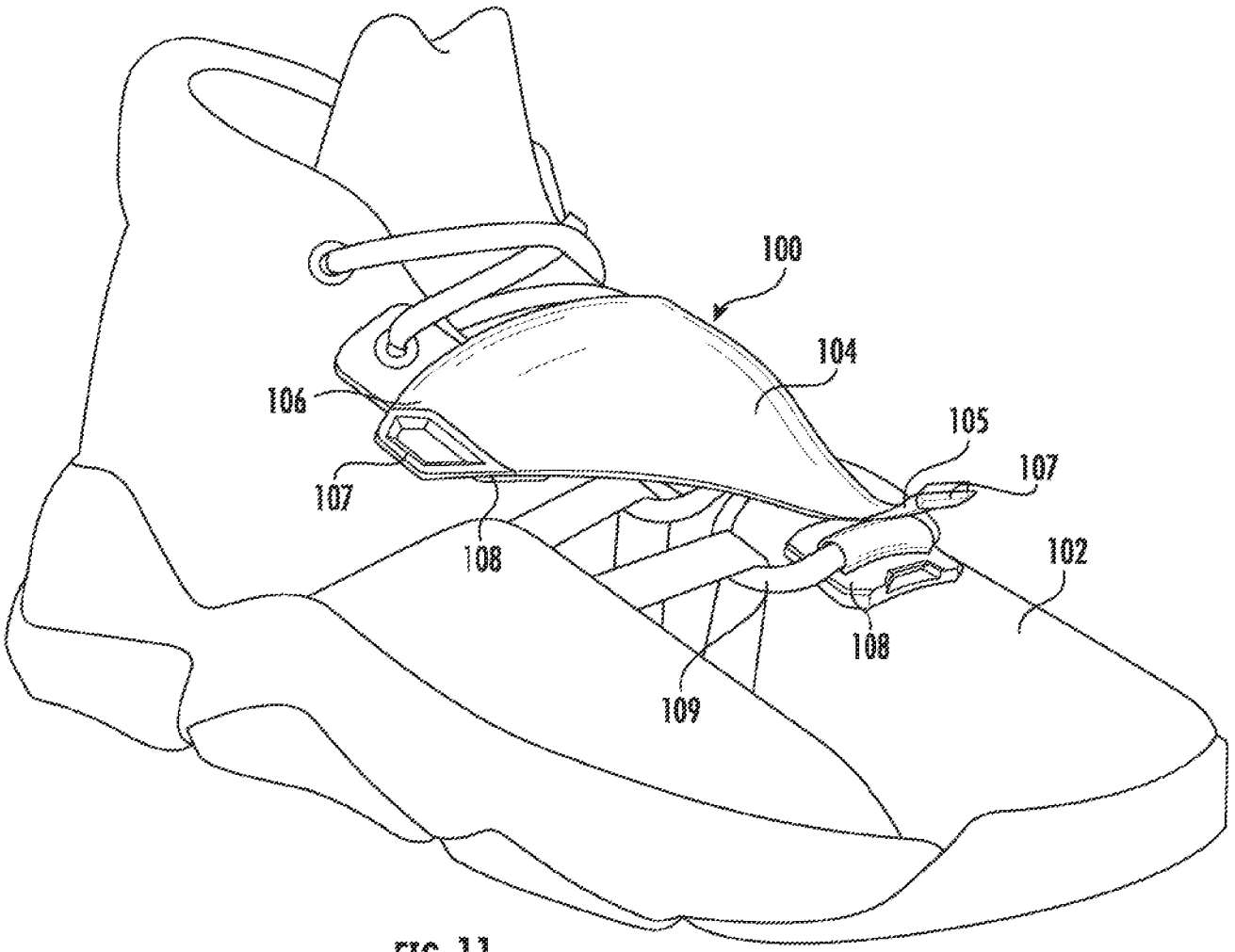
FIG. 11 depicts an embodiment of a shoe bottom cleansing apparatus attachable to a shoe with a magnet attachment.

Referring now to FIG. 11, shown therein is an embodiment of a shoe bottom cleansing apparatus 100 removably connected to a shoe 102. The shoe bottom cleansing apparatus 100 is provided with a cleansing portion 104 having a first end 105 and a second end 106. The cleansing portion 104 is configured to be positioned over a top portion of the shoe 102. A plurality of first magnets 107 are configured to be attached to a portion of the first end 105 and the second end 106 of the cleansing portion 104 so as to be correspondingly attachable to a plurality of second magnets 108 attached to laces 109 of the shoe 102 so that the shoe bottom cleansing apparatus 100 is connected to the shoe 102.

Figure 12:
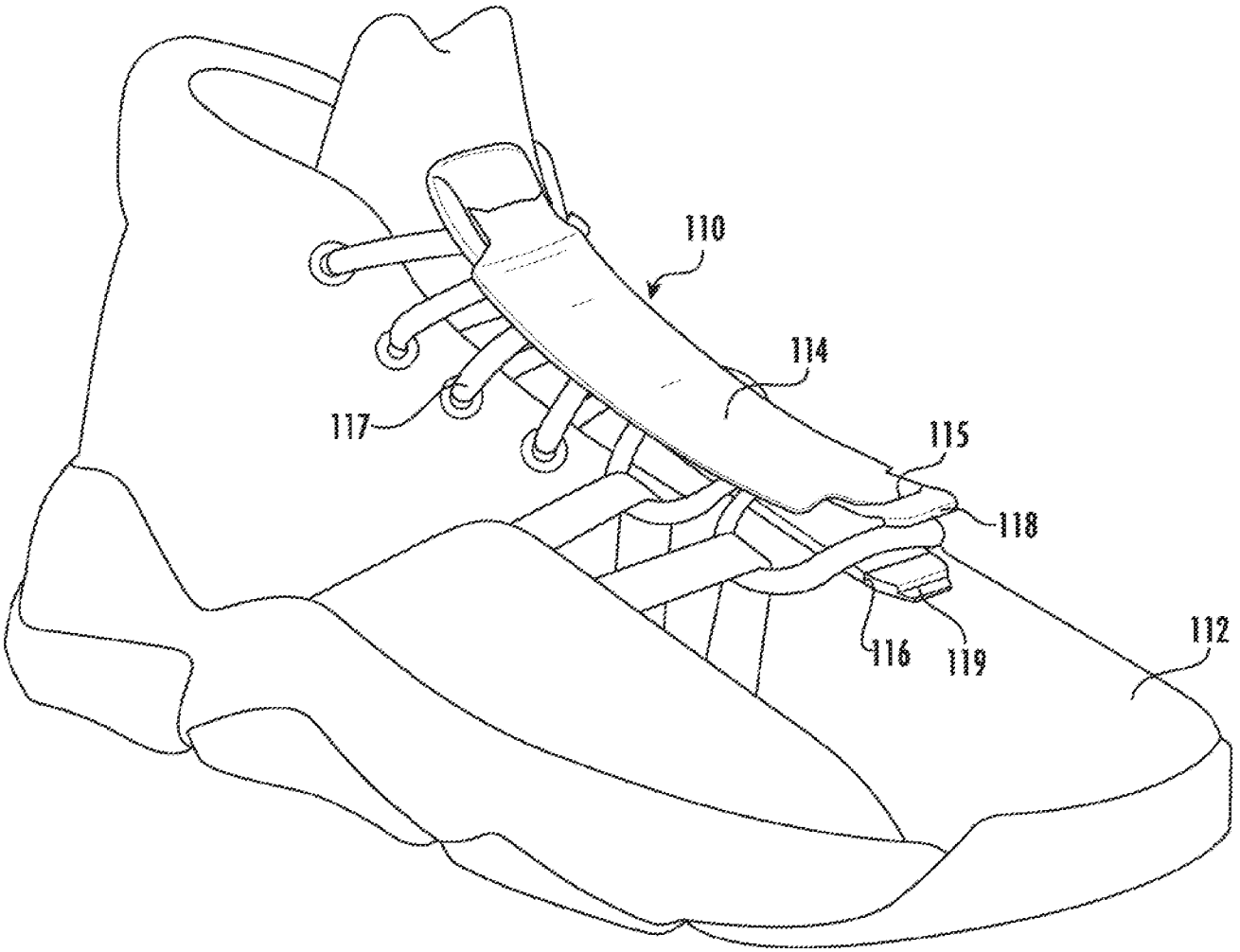
FIG. 12 depicts an embodiment of a shoe bottom cleansing apparatus attachable to a shoe with a snap closure.

Now referring now to FIG. 12, another embodiment of a shoe bottom cleansing apparatus 110 is shown removably connected to a shoe 112. The shoe bottom cleansing apparatus 110 is provided with a first end 115 and a second end 116 with a cleansing portion 114 positioned therebetween. The shoe bottom cleansing apparatus 110 is wrapped about the laces 117 such that the laces 117 are enclosed by the shoe bottom cleansing apparatus 110. The first end 115 is provided with a first connection member 118 and the second end 116 is provided with a second connection member 119 that corresponds to the connection member 118 so that the shoe bottom cleansing apparatus 110 is connected to the laces 117 of the shoe 112. In one embodiment, the connection member 118 and 119 are snap portions.

Figure 14:
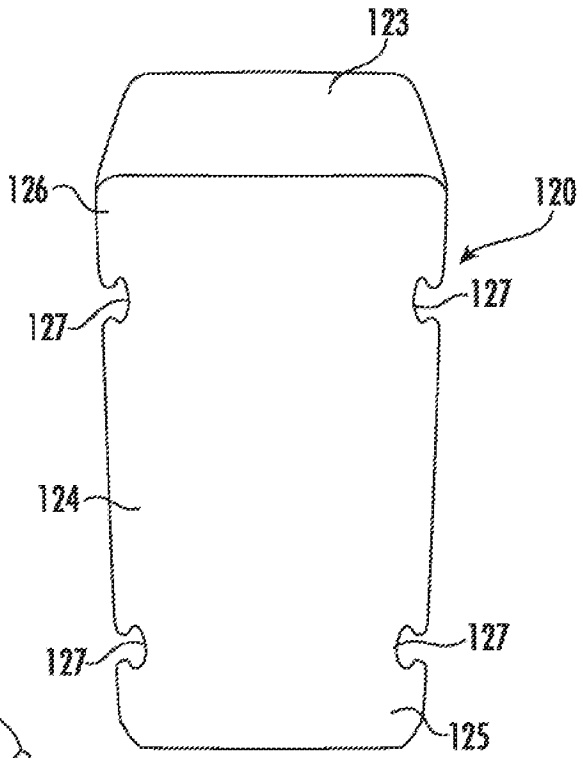
FIG. 14 depicts the shoe bottom cleansing apparatus of FIG. 13.
Figure 14:
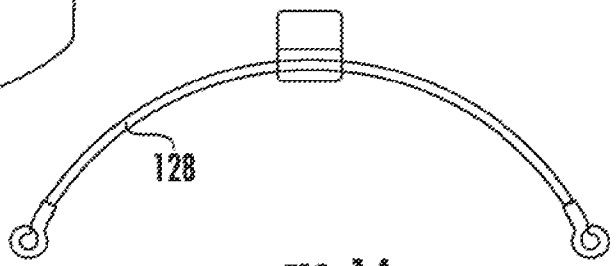
Figure 13:
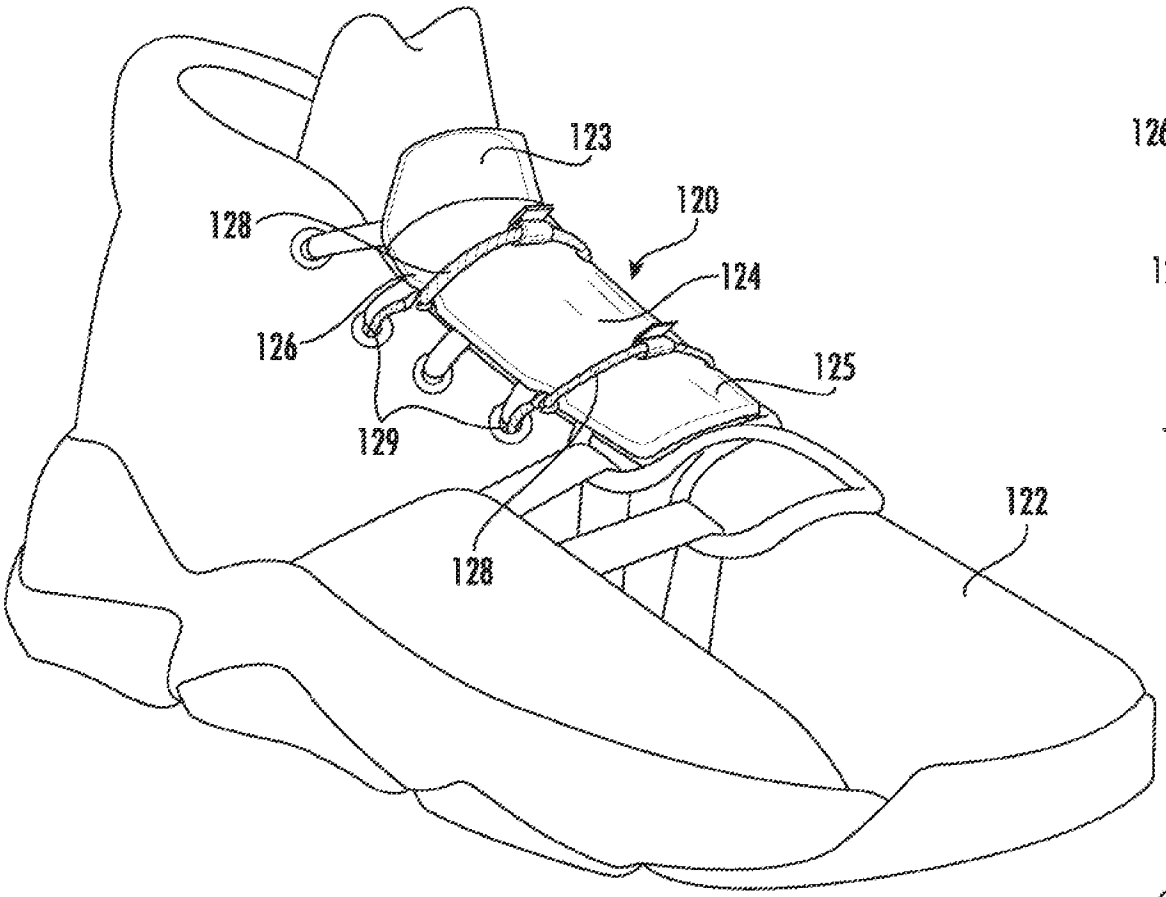
FIG. 13 depicts an embodiment of a shoe bottom cleansing apparatus attachable to a shoe with a plurality of straps.

Referring now to FIGS. 13-14, an embodiment of a shoe bottom cleansing apparatus 120 is shown connected to a shoe 122. The shoe bottom cleansing apparatus 120 is provided with a cleansing portion 124 having a first end 125 and a second end 126. The cleansing portion 124 is provided with a plurality of notches 127 along each side of the cleansing portion 124 for receiving a plurality of straps 128. In an embodiment, the straps 128 are elastic. The cleansing portion 124 is configured to be positioned over the top of the shoe 122. Each strap 128 is threaded through eyelets 129 of the shoe 122 and is positioned in the notches 127 of the cleansing portion 124 so that each strap 128 is wrapped about the cleansing portion 124 to attach the shoe bottom cleansing apparatus 120 to the shoe 122. In one embodiment, the shoe bottom cleansing apparatus 120 is provided with a platform 123 for placing a brand, team logo or other names, logos, art, words, etc., as so desired.

Figure 16:
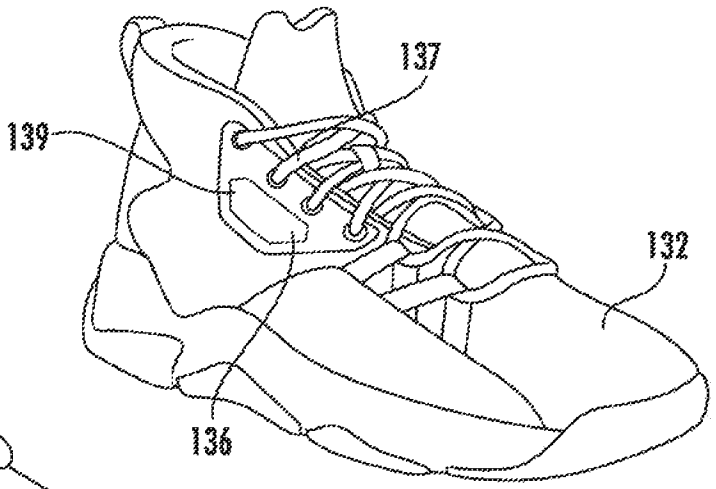
FIG. 16 depicts the lace attachment platforms of FIG. 15.
Figure 15:
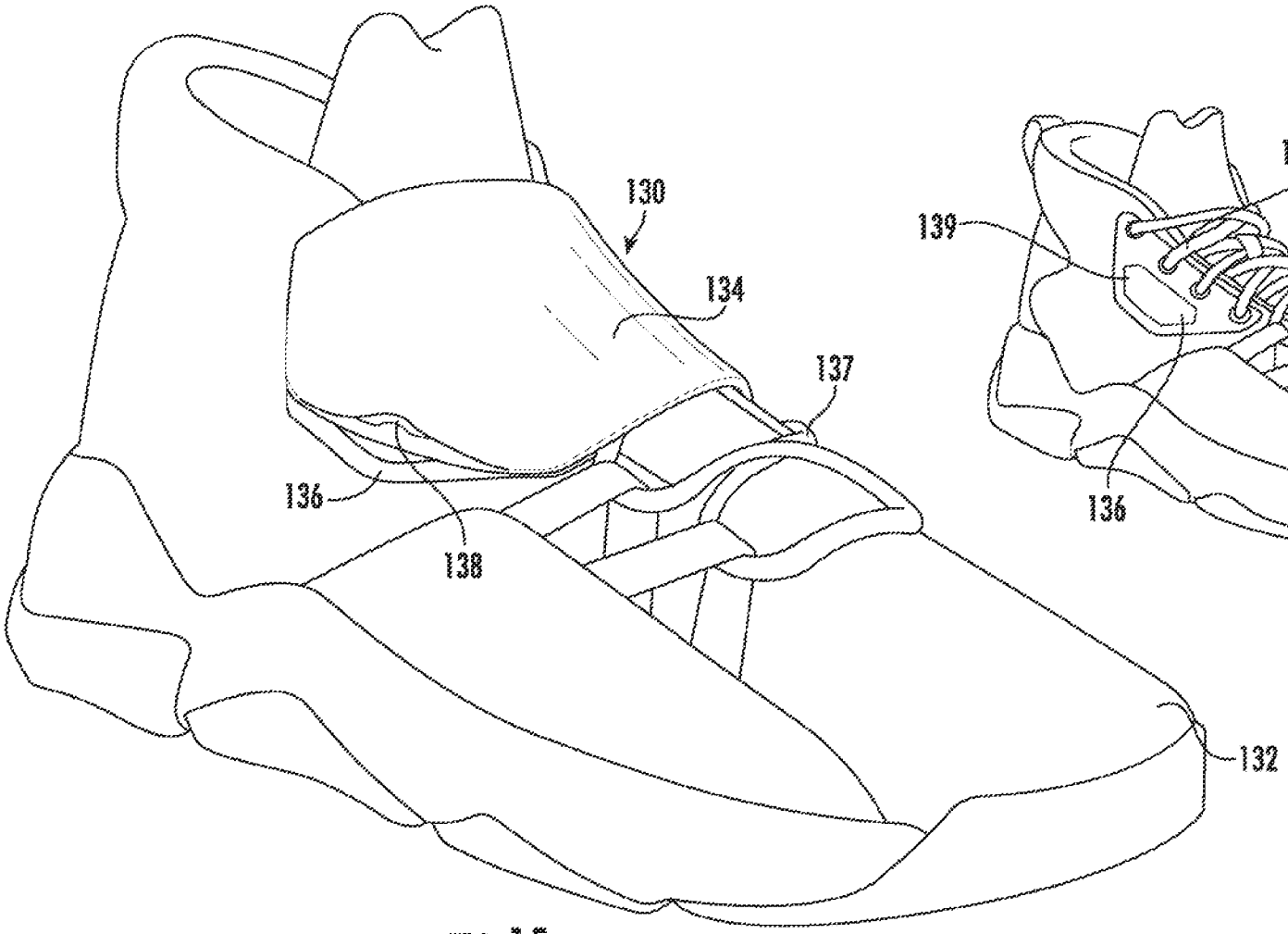
FIG. 15 depicts another embodiment of a shoe bottom cleansing apparatus attachable to a shoe with lace attachment platforms.

Referring now to FIGS. 15-16, another embodiment of a shoe bottom cleansing apparatus 130 is shown connected to a shoe 132. The shoe bottom cleansing apparatus 130 is provided with a cleansing portion 134 and a plurality of attachment platforms 136. Each platform 136 is configured to be attachable to the laces 137 of the shoe 132. In one embodiment, the underside or opposing side of the cleansing portion 134 includes a connecting material 138, such as Velcro®, to correspond to a connecting material 139 positioned on a portion of each attachment platform 136 so that the cleansing portion 134 is connected to the attachment platform 136 thereby connecting the shoe bottom cleansing apparatus 130 to the shoe 132.

Figure 17:
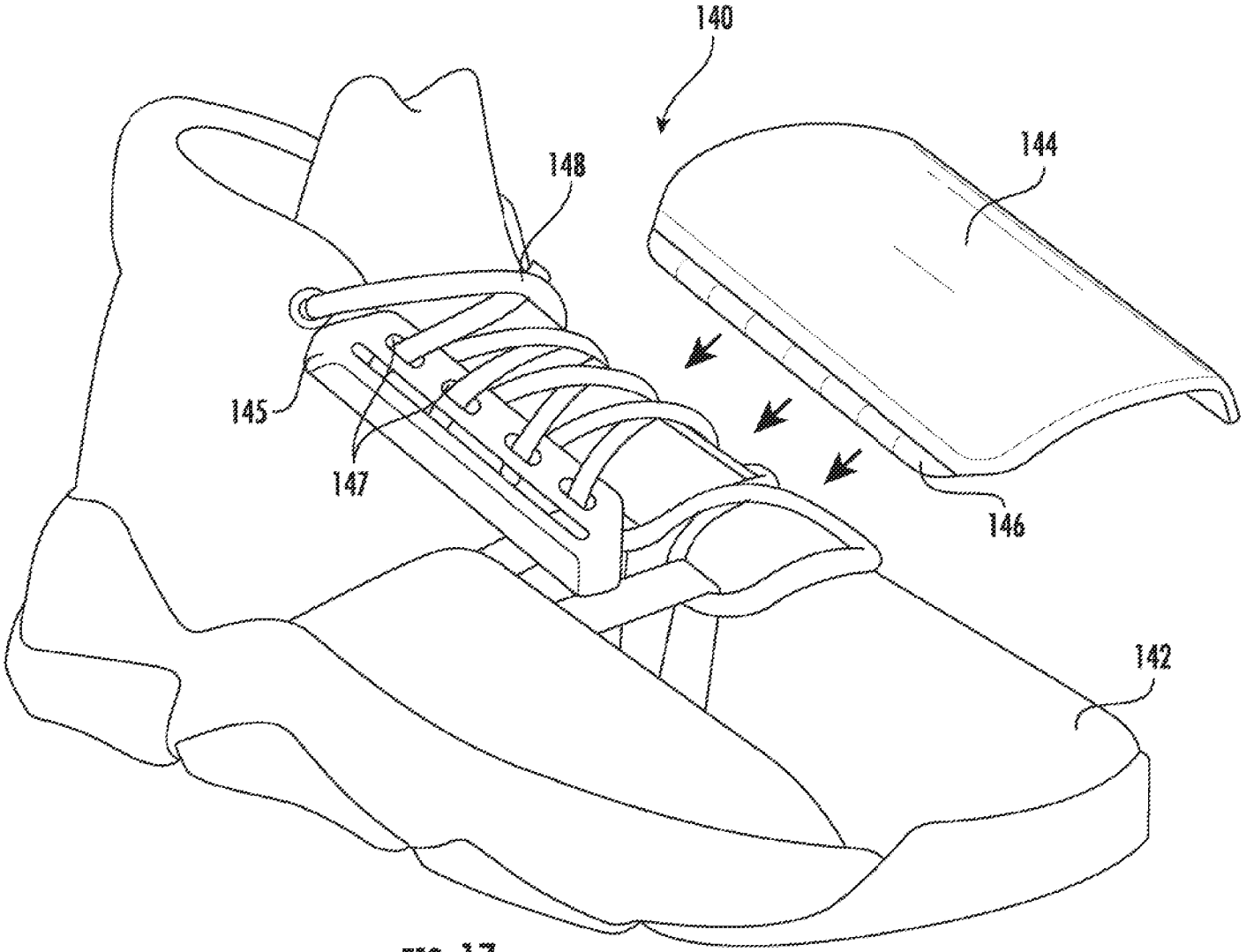
FIG. 17 depicts an alternative embodiment of a shoe bottom cleansing apparatus attachable to a shoe with a magnetic strip.

Now referring to FIG. 17, shown therein is an embodiment of a shoe bottom cleansing apparatus 140 removably connected to a shoe 142. The shoe bottom cleansing apparatus 140 is provided with a cleansing portion 144 and an attachment platform 145. At least one side of the cleansing portion 144 is provided with a magnetic strip 146. In one embodiment, the magnetic strip 146 is flexible. The attachment platform 146 includes a plurality of eyelets 147 for receiving laces 148 of the shoe 142 and a magnetic portion 149 which corresponds to the magnetic strip 146 of the cleansing portion 144 so that the cleansing portion 144 is attached to the attachment platform 145 such that the shoe bottom cleansing apparatus 140 is connected to the shoe 142.

Figure 18:
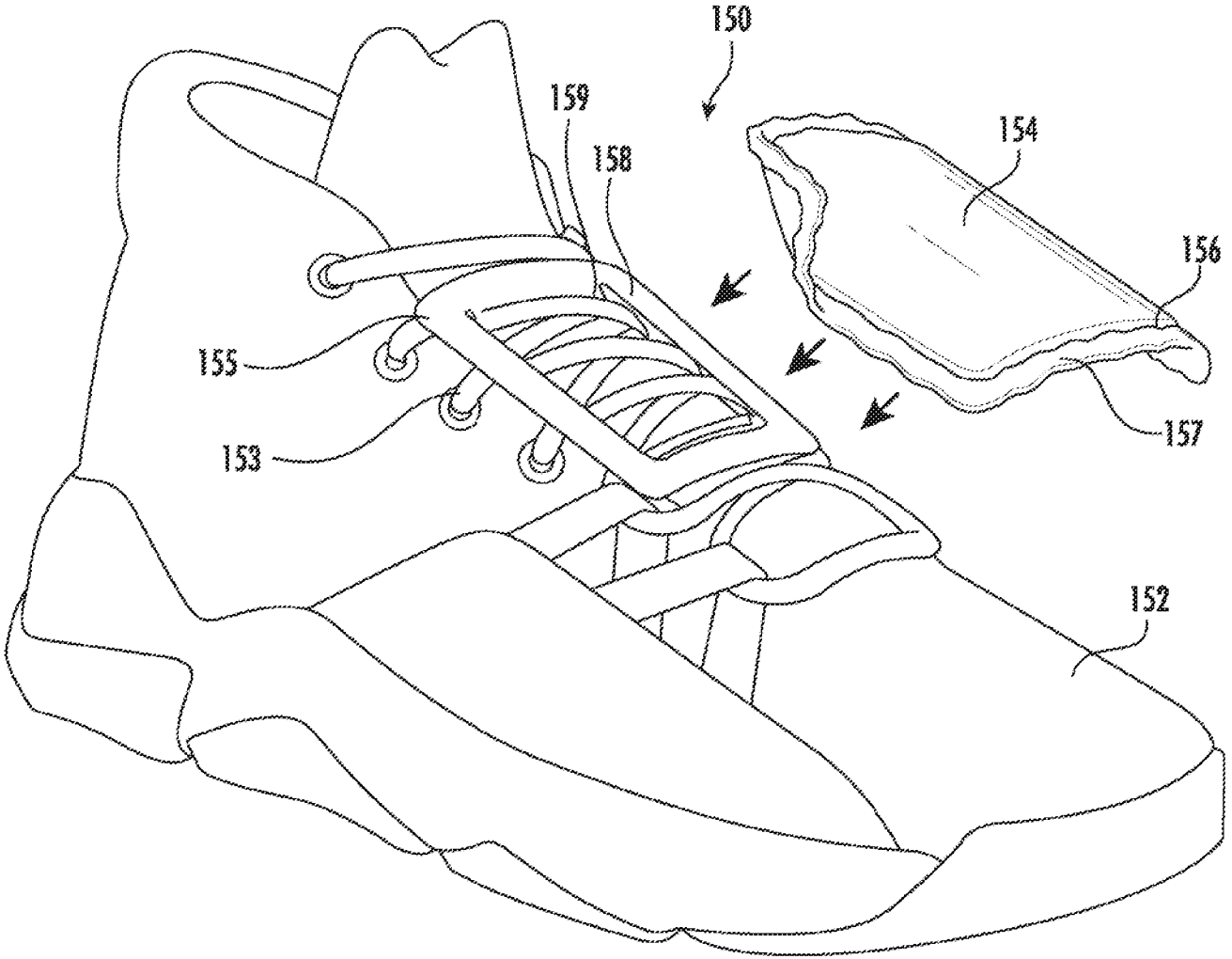
FIG. 18 depicts an embodiment of a shoe bottom cleansing apparatus attachable to a shoe with a binding edge.

Referring to FIG. 18, another embodiment of a shoe bottom cleansing apparatus 150 is shown removably connected to a shoe 152 having laces 153. The shoe bottom cleansing apparatus 150 is provided with a cleansing portion 154 and an attachment platform 155. An edge 156 of the cleansing portion 154 is provided with an elastic bind 157 for attaching to the attachment platform 155. The attachment platform 155 includes an outer perimeter 158 having a tab portion 159. The tab portion 159 is configured to be positioned behind the laces 153 so that the attachment platform 155 is attached to the shoe 152. The elastic bind 157 is positioned about the outer perimeter 158 of the attachment platform 155 so that the cleansing portion 154 is connected to the attachment platform 155 such that the shoe bottom cleansing apparatus 150 is attached to the shoe 152.

Figure 19:
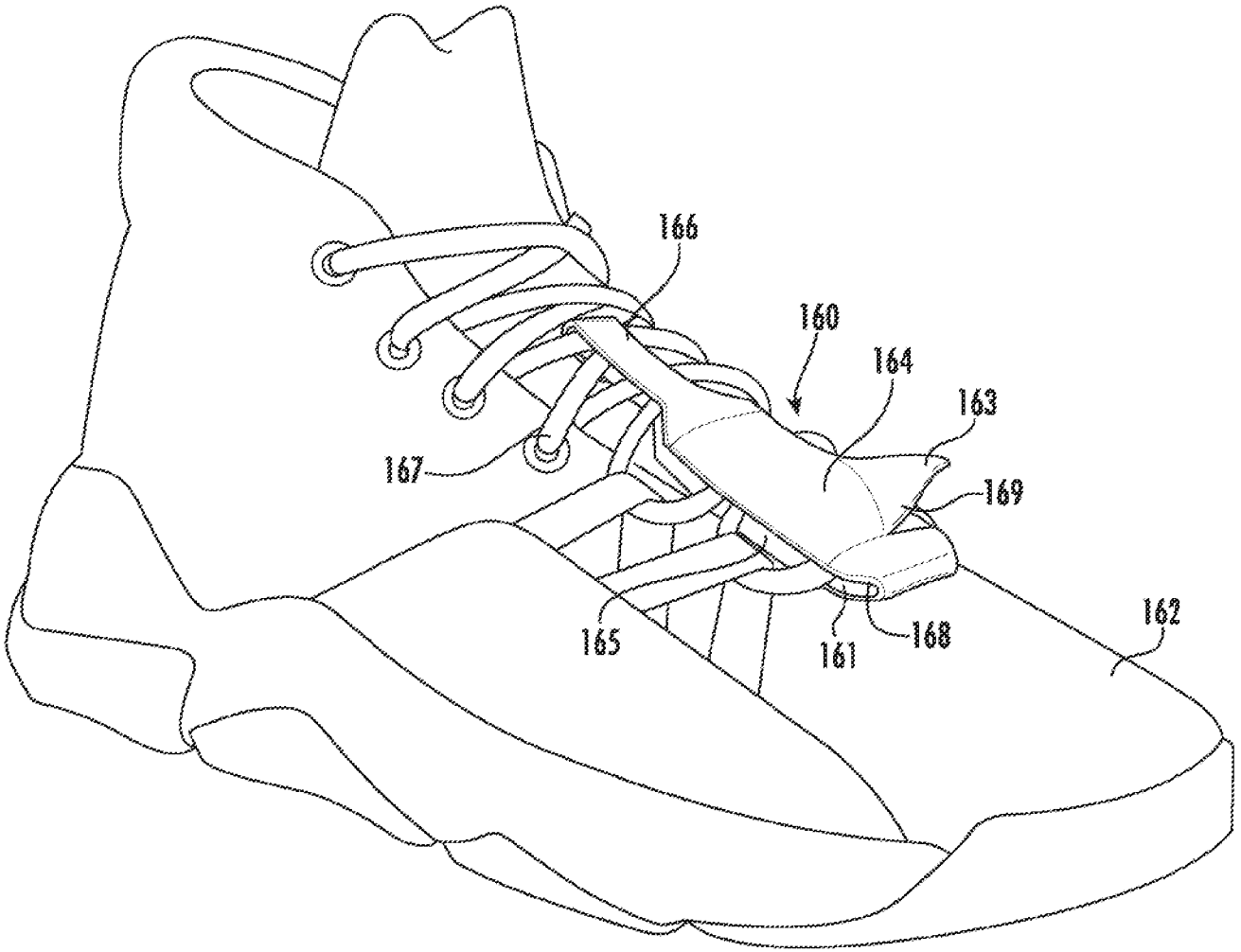
FIG. 19 depicts another embodiment of a shoe bottom cleansing apparatus attachable to a shoe with a hook and loop attachment.

Referring now to FIG. 19, an embodiment of a shoe bottom cleansing apparatus 160 is shown connected to a shoe 162. The shoe bottom cleansing apparatus 160 has a first end 161, a second end 163 and cleansing portion 164 positioned near the second end 163 of the shoe bottom cleansing portion 164. A portion 165 of the first end 161 has a substantially similar configuration to the second end 163. An attachment portion 166 is positioned between the first end 161 and the second end 163 such that the attachment portion 166 is configured to have a diameter less than the first end 161 and the second end 163. The first end 161 is wrapped about the laces 167 such that the laces 167 are positioned between the portion 165 of the first end 161 and the cleansing portion 164. A connecting material 168 is positioned on the first end 161 to correspond to a connecting material 169 on the second end 163 so that the shoe bottom cleansing apparatus 160 is attached to the shoe 162.

Figures 20, 21:
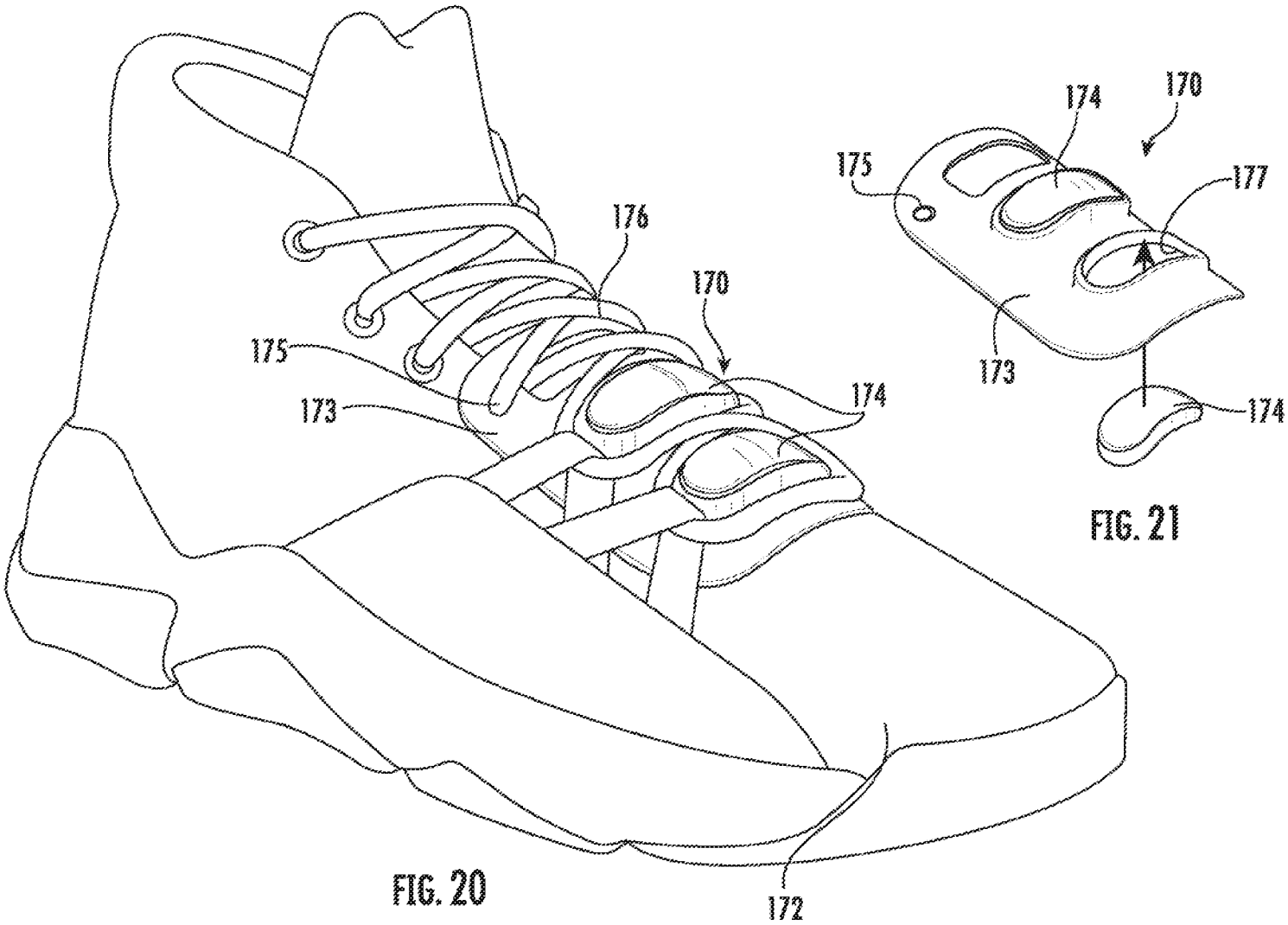
FIG. 20 depicts another embodiment of a shoe bottom cleansing apparatus attachable to a shoe with a connector assembly.
FIG. 21 depicts the connector assembly of FIG. 20.

Now referring to FIGS. 20-21, an embodiment of a shoe bottom cleansing apparatus 170 is shown attached to a shoe 172. The shoe bottom cleansing apparatus 170 includes an attachment portion 173 and a plurality of cleansing portions 174. The attachment portion 173 has at least one eyelet portion 175 for receiving laces 176 of the shoe 172 and a plurality of openings 177 for receiving the cleansing portions 174. The attachment portion 173 is positioned under the laces 176 and the eyelet portion 175 receives the lace 176 so as to connect the attachment portion 173 to the shoe 172. In one embodiment, the cleansing portions 174 are configured as pods which can be removed from the opening 177 and replaced with a new pod after extended use.

Figure 22:
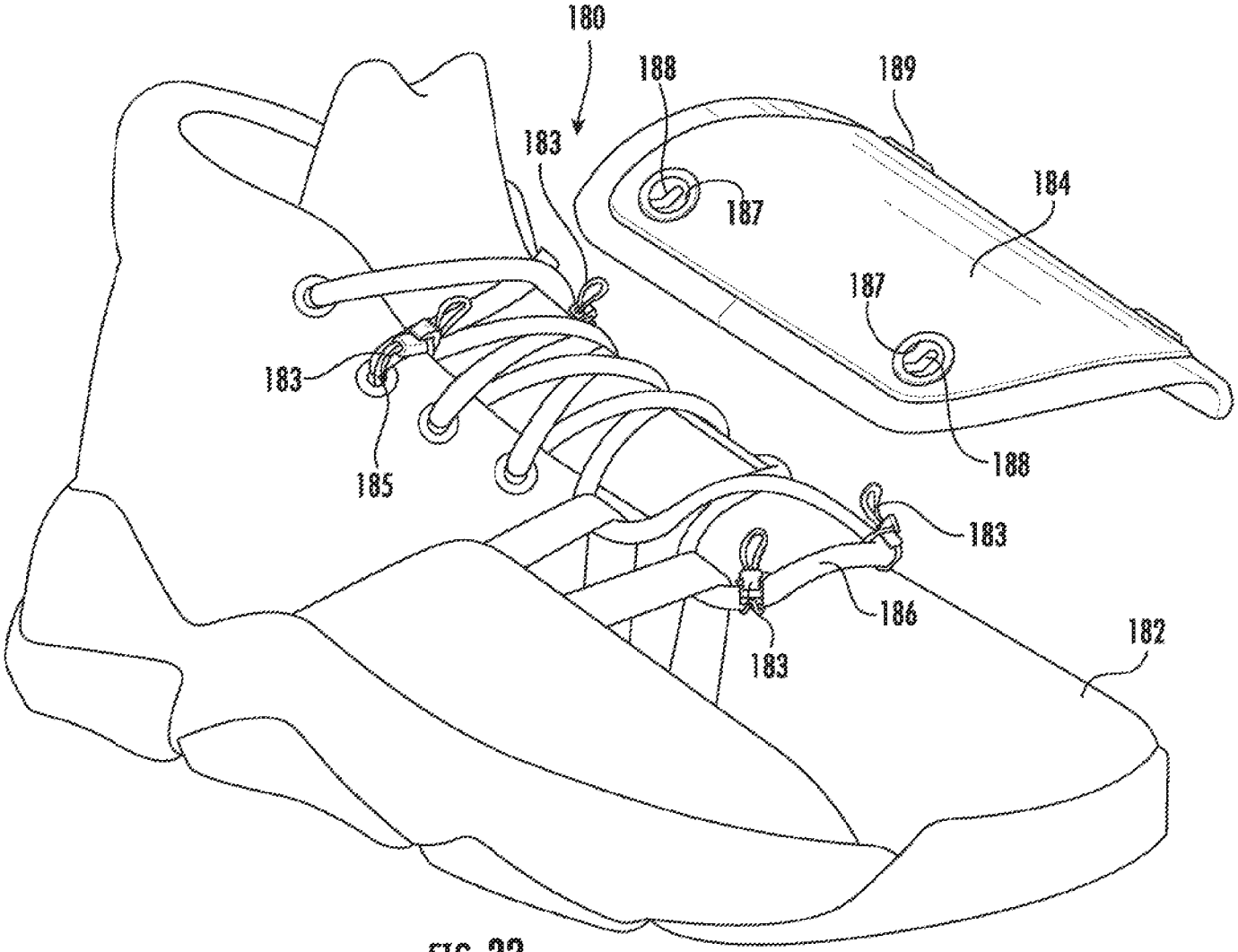
FIG. 22 depicts an embodiment of a shoe bottom cleansing apparatus attachable to a shoe with an attachment assembly.

Referring now to FIG. 22, an embodiment of a shoe bottom cleansing apparatus 180 is shown removably attachable to a shoe 182. The shoe bottom cleansing apparatus 180 includes a plurality of attachment members 183 and a cleansing portion 184. In one embodiment, the plurality of attachment members 183 are elastic hoops with hooks that are attached to a plurality of eyelets 185 and the laces 186 of the shoe 182. The cleansing portion 184 has a plurality of openings 187 wherein each opening 187 has a grommet 188 for receiving the hook 183. The cleansing portion 184 is positioned over the laces 186 of the shoe 182. Each of the hooks 183 is positioned in the opening 187 and is attached about the grommet 188 of the cleansing portion 184 such that the cleansing portion 184 is attached to the shoe 182.

Figure 23:
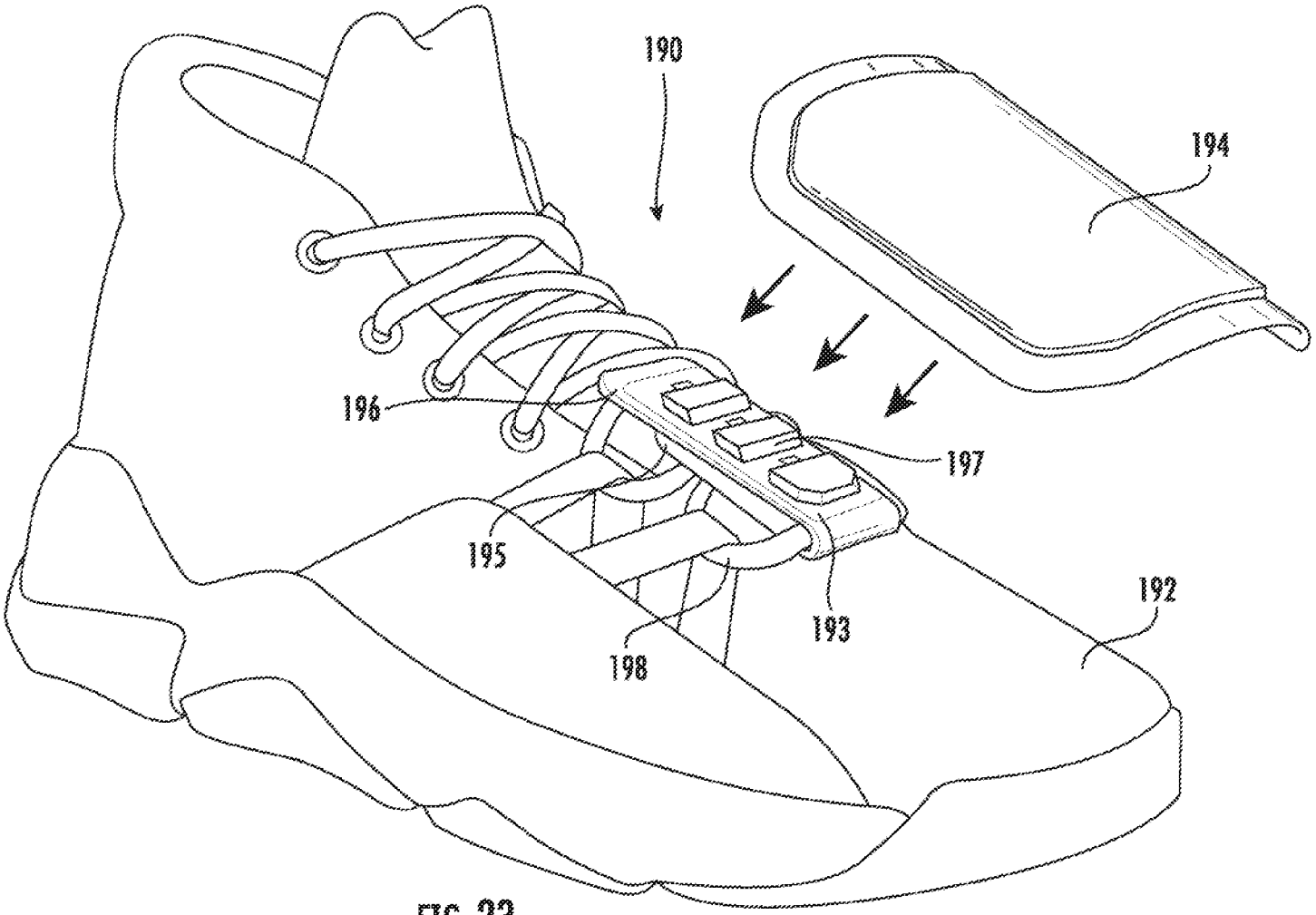
FIG. 23 depicts another embodiment of a shoe bottom cleansing apparatus attachable to a shoe with a fidlock clip.

Referring to FIG. 23, an embodiment of a shoe bottom cleansing apparatus 190 is shown removably attachable to a shoe 192. The shoe bottom cleansing apparatus 190 includes an attachment platform 193 and a cleansing portion 194. The attachment platform 193 has a first end 195, a second end 196 and an attachment portion 197 positioned therebetween. The attachment platform 193 wraps about the laces 198 of the shoe 192 such that the attachment portion 197 faces upward for receiving the cleansing portion 194. In one embodiment, the attachment portion 197 is a plurality of fidlock clips. The underside (not shown) of the cleansing portion 194 has a plurality of connectors corresponding to the attachment portion 197 for connecting the cleansing portion 194 to the attachment platform 193 so that the shoe bottom cleansing apparatus 190.

Figure 24:
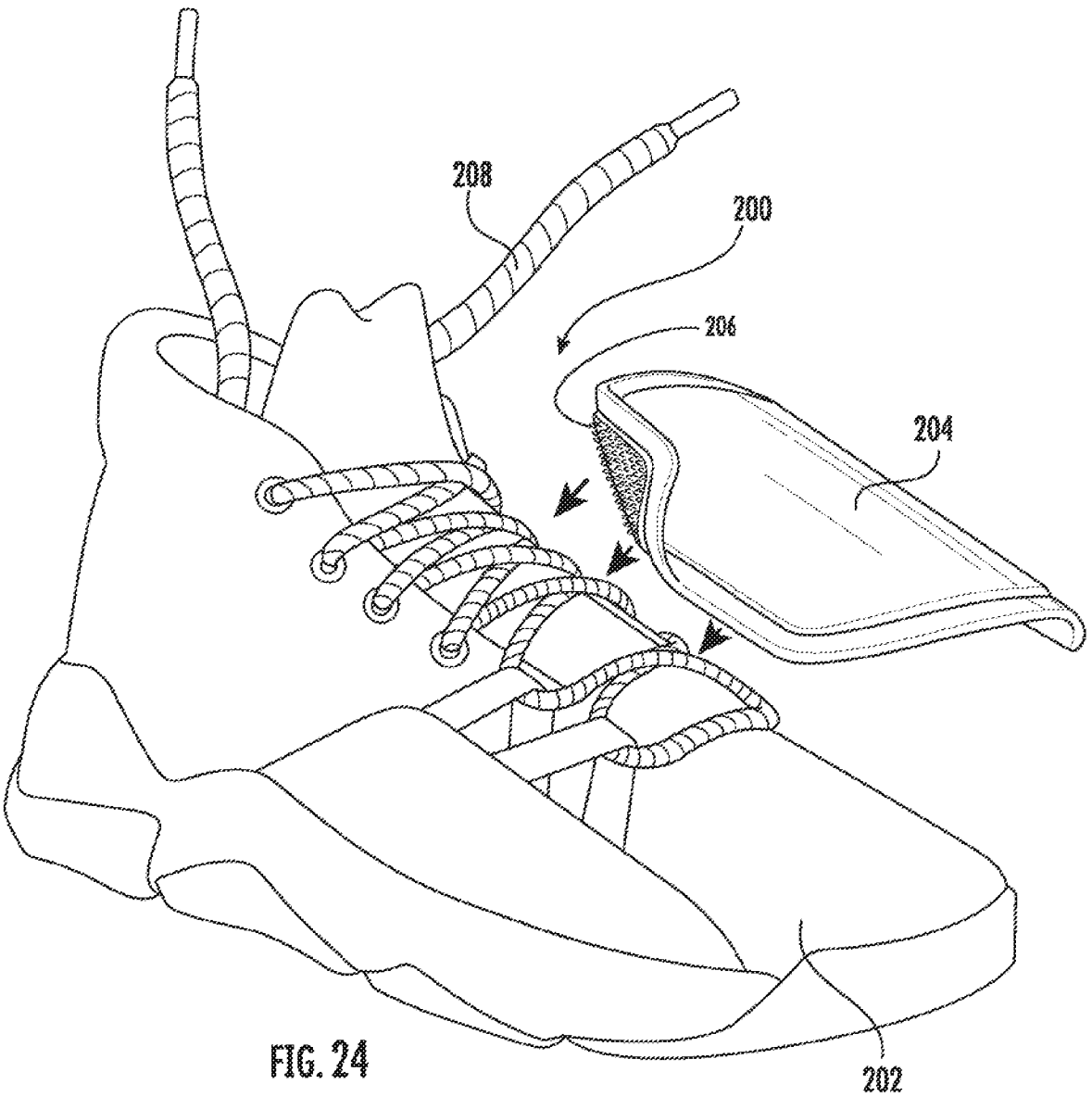
FIG. 24 depicts an embodiment of a shoe bottom cleansing apparatus attachable to a shoe with a Velcro® attachment.

Referring now to FIG. 24, an embodiment of a shoe bottom cleansing apparatus 200 is shown removably connected to a shoe 202. The shoe bottom cleaning apparatus 200 has a cleansing portion 204 and a connecting member 206 positioned on an opposing side of the cleansing portion 204. In one embodiment, the connecting member 206 is constructed from a hook and loop or Velcro® material. Velcro® compatible shoe laces 208 are provided in the shoe 202 so that the connecting member 206 is positioned about the laces 208 so that the shoe bottom cleansing apparatus 200 is connected to the shoe 202.

Figure 25:
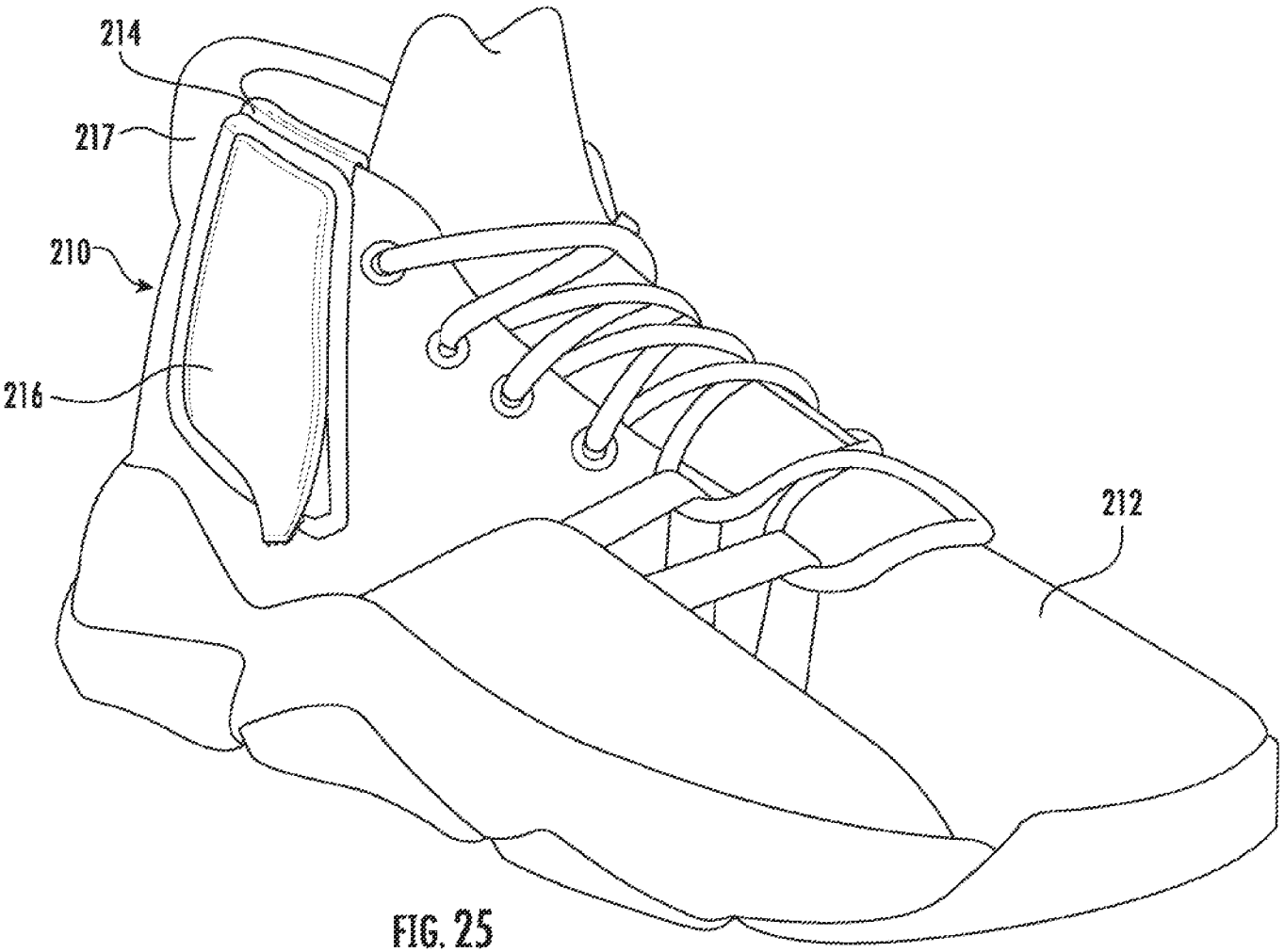
FIG. 25 depicts an embodiment of a shoe bottom cleansing apparatus attachable to a shoe with an attachment member.

Referring now to FIG. 25, an embodiment of a shoe bottom cleansing apparatus 210 is shown attached to a shoe 212. The shoe bottom cleansing apparatus 210 includes an attachment member 214 and a cleansing portion 216. The attachment member 214 is connected to an ankle portion 217 of the shoe 212 and the cleansing portion 216 is connected to the attachment member 214.

Figure 26:
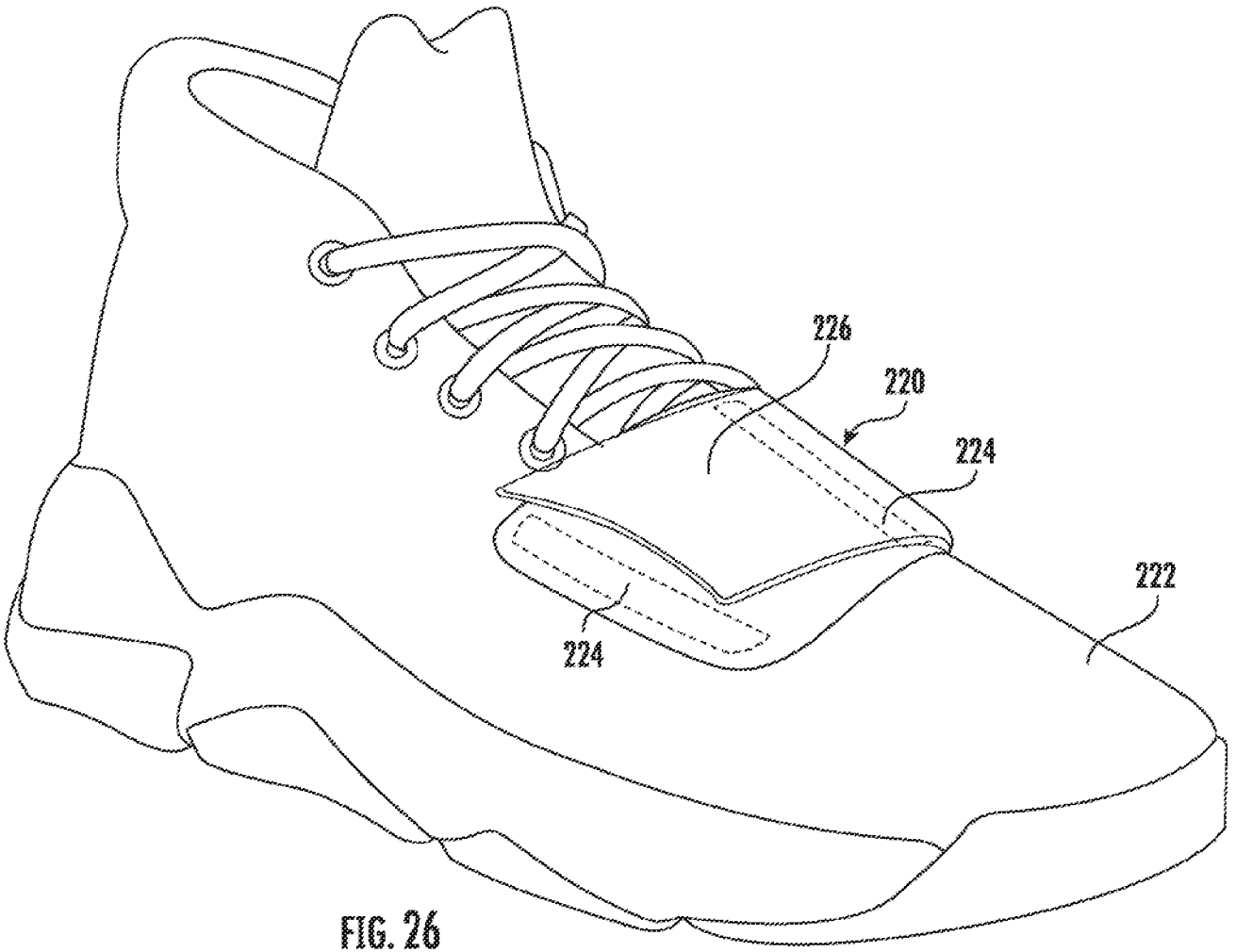
FIG. 26 depicts another embodiment of a shoe bottom cleansing apparatus attachable to a shoe with an attachment member.

Referring to FIG. 26, another embodiment of a shoe bottom cleansing apparatus 220 is show attached to a shoe 222. A Velcro® strap or material 224 is built or stitched into the shoe 222. An example of the type of shoe 222 used in this embodiment may be Adidas® Harden Vol. 3, Nike® LeBron Soldier 12, Nike® PG 2.5, Nike® KD Trey 5 VI, and the like. The top of the Velcro® strap is constructed or provided with a cleansing portion 226 for wiping the bottom of an opposite shoe of the pair of shoes 222. The cleansing portion 226 may also be provided as a separate sleeve that is attached to the Velcro® strap 224.

Figure 27:
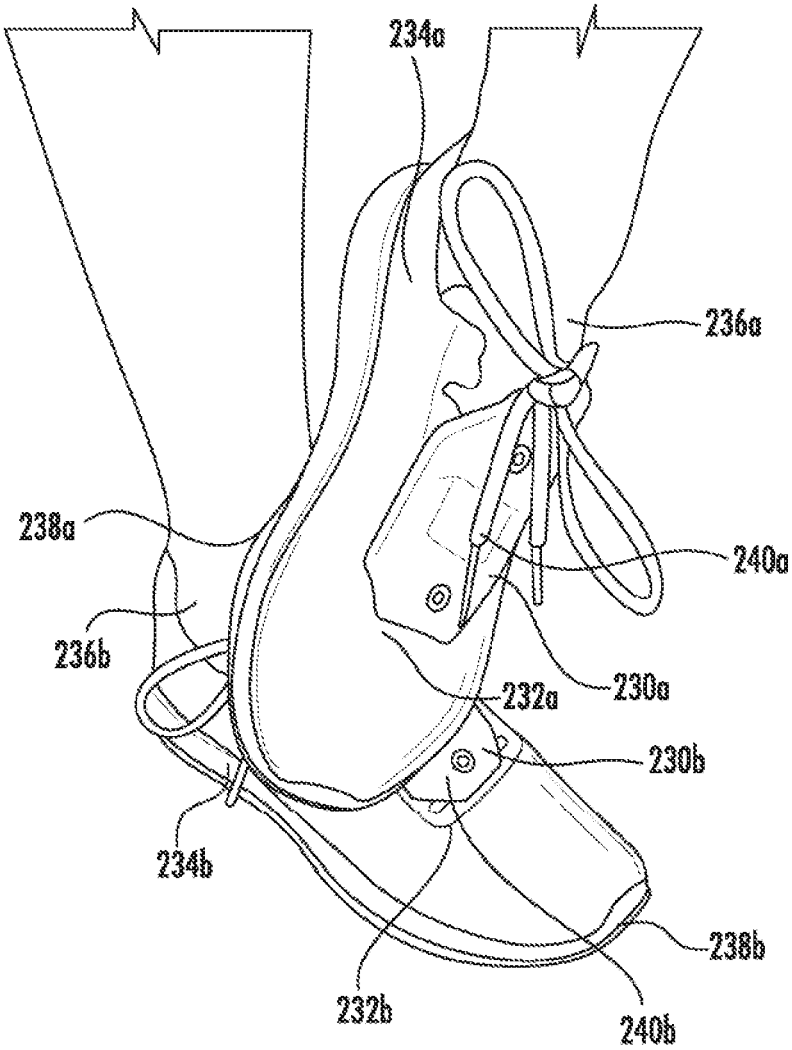
FIG. 27 is a perspective view of one embodiment of a shoe bottom cleansing apparatus attached to a shoe worn by an individual.

As shown in FIG. 27, one embodiment of a shoe bottom cleansing apparatus **230*a* and 230*b* are attached to a front portion 232*a* and a front portion 232*b* of shoes 234*a* and 234*b* worn on feet 236*a* and 236*b* of an individual. To clean a bottom 238*a* of the shoe 234*a*, the individual raises his/her foot 236*a* and thus, the shoe 234*a* so that the bottom 238*a* of the shoe 234*a* is positioned on a cleansing portion 240*b* of the shoe bottom cleansing apparatus 230*b*. The individual may move the shoe 236*a* in various directions so that the bottom 238*a* of the shoe 236*a* rubs against the cleansing portion 240*b* so that the bottom 238*a* of the shoe 236*a* is cleaned. It should be understood by one of ordinary skill in the art that the same process may be conducted to clean a bottom 238*b* of the shoe 236*b* against a cleansing portion 240*a* of the shoe bottom cleansing apparatus 230*a* attached to the shoe 236*a***.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover, in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art. The terms "coupled" and "linked" as used herein is defined as connected, although not necessarily directly and not necessarily mechanically. A device or structure that is "configured" in a certain way is configured in at least that way but may also be configured in ways that are not listed. Also, the sequence of steps in a flow diagram or elements in the claims, even when preceded by a letter does not imply or require that sequence.

What is claimed is:

1. A shoe bottom cleansing apparatus configured to be attached to a first shoe, the shoe bottom cleansing apparatus comprising:

a base having a first end, a second end, and a base thickness;

a plurality of cleansing portions extending from the base, wherein the plurality of cleansing portions comprise a cleansing portion thickness, wherein the plurality of cleansing portions comprise:

a first cleansing portion having a first shape; and a second cleansing portion having a second shape, wherein the second shape is different than the first shape and complementary to the first shape;

wherein the base thickness is between about 1 mm and 3 mm, and the cleansing portion thickness is between 2 mm and 6 mm, thereby forming a groove disposed between the first cleansing portion and the second cleansing portion;

wherein the base and the plurality of cleansing portions are constructed of a flexible material having a hardness between Shore 30 and Shore 70 on a Shore A scale;

a fabric overlying the flexible material of the base and the plurality of cleansing portions, the fabric being configured to contact a bottom of a second shoe and thereby clean the bottom of the second shoe;

a first means for removably attaching the first end of the base to a top portion of the first shoe; and a second means for removably attaching the second end of the base to the top portion of the first shoe.

2. The shoe bottom cleansing apparatus of claim 1, wherein the first means for removably attaching the first end of the base to the top portion of the first shoe comprises attaching the base to a portion of a lace of the first shoe.

3. The shoe bottom cleansing apparatus of claim 2, wherein the first means for removably attaching the first end of the base to the top portion of the first shoe comprises at least one aperture through which the lace is woven.

4. The shoe bottom cleansing apparatus of claim 3, wherein the least one aperture is disposed in the base.

5. The shoe bottom cleansing apparatus of claim 3, wherein the second means for removably attaching the second end of the base to the top portion of the first shoe comprises attaching the base to another portion of the lace of the first shoe.

6. The shoe bottom cleansing apparatus of claim 5, wherein the second means for removably attaching the second end of the base to the top portion of the first shoe comprises configuring the second end to wrap about the other portion of the lace of the first shoe.

7. The shoe bottom cleansing apparatus of claim 1, wherein the second means for removably attaching the second end of the base to the top portion of the first shoe comprises attaching the base to another portion of the lace of the first shoe.

8. The shoe bottom cleansing apparatus of claim 7, wherein the second means for removably attaching the second end of the base to the top portion of the first shoe comprises configuring the second end to wrap about the other portion of the lace of the first shoe.

9. The shoe bottom cleansing apparatus of claim 1, wherein the fabric comprises a microfiber.

10. The shoe bottom cleansing apparatus of claim 1, wherein the flexible material comprises at least one of ethylene vinyl acetate, a cross-linked foam, a polyvinyl chloride foam, an open cell urethane, and a thermoplastic urethane film.

* * * * *